United States Patent [19]

Puchala et al.

[11] Patent Number: 4,854,770

[45] **Date of Patent: * Aug. 8, 1989**

[54] METHOD AND APPARATUS FOR REMOVAL OF SURFACE MATERIAL

[75] Inventors: Ryszard J. Puchala, Scarborough; Stephen J. Miko, Toronto, both of Canada

[73] Assignee: Indescor Hydrodynamics Inc., Concord, Canada

[ * ] Notice: The portion of the term of this patent subsequent to Feb. 3, 2004 has been disclaimed.

[21] Appl. No.: 948,133

[22] Filed: Dec. 31, 1986

Related U.S. Application Data

[63] Continuation-in-part of Ser. No. 722,454, Apr. 12, 1985, Pat. No. 4,640,644.

[51] Int. Cl.[4] ..... E01C 23/12

[52] U.S. Cl. ..... 404/75; 299/17; 299/36; 404/90

[58] Field of Search ..... 404/75, 90, 84; 299/16, 299/17, 36, 37, 39; 241/1, 101.7

[56] References Cited

U.S. PATENT DOCUMENTS

| | | | |
|---|---|---|---|
| 2,423,787 | 7/1947 | Mosena et al. | 299/37 X |
| 2,878,002 | 3/1959 | Haley | 299/36 |
| 3,172,483 | 3/1965 | Spitzer | 173/22 |
| 3,538,803 | 11/1970 | Joseph | 241/1 |
| 3,614,163 | 10/1971 | Anderson | 299/17 |
| 3,729,137 | 4/1973 | Cobb et al. | 239/101 |
| 3,792,907 | 2/1974 | Anderson | 299/17 |
| 3,810,676 | 5/1974 | Clarke | 404/84 X |
| 3,857,516 | 12/1974 | Taylor | 299/17 |
| 3,910,815 | 10/1975 | Shelor | 239/186 |
| 4,081,200 | 3/1978 | Cheung | 299/17 |
| 4,619,551 | 10/1986 | Juan et al. | 404/90 |
| 4,640,644 | 2/1987 | Puchala et al. | 404/75 |
| 4,753,549 | 6/1988 | Shook et al. | 404/75 |
| 4,761,039 | 8/1988 | Hilaris | 299/39 |
| 4,793,734 | 12/1988 | Shook et al. | 404/90 |
| 4,795,217 | 1/1989 | Hilaris | 299/36 |

FOREIGN PATENT DOCUMENTS 3240544 4/1984 Fed. Rep. of Germany .

*Primary Examiner*—Jerome W. Massie, IV
*Assistant Examiner*—Matthew Smith

[57] ABSTRACT

Material, such as old unsound concrete material, is removed from a work surface by discharging water against such work surface at a pressure of from about 10,000 to about 25,000 psi from a rotating nozzle. During operation, the nozzle traverses the work surface along a series of linear paths and is incrementally moved in a longitudinal direction so as to pass over the work surface in a sequence of preferably overlapping transverse bands. An apparatus for carrying out the method of the invention comprises a support structure usefully in the form of a vehicle having an extendible arm driven by an extension means for incremental movement of that arm in a longitudinal direction. A rotatable nozzle is mounted on a nozzle support in turn secured to the extendible arm for bidirectional movement of the nozzle along a transverse linear path. Casters are also provided for maintaining the nozzle at a predetermined spacing from the work surface during operation of the apparatus.

27 Claims, 14 Drawing Sheets

FIG. 7.
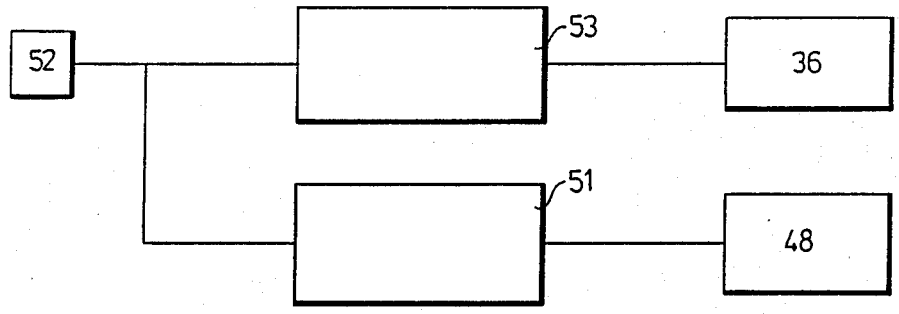
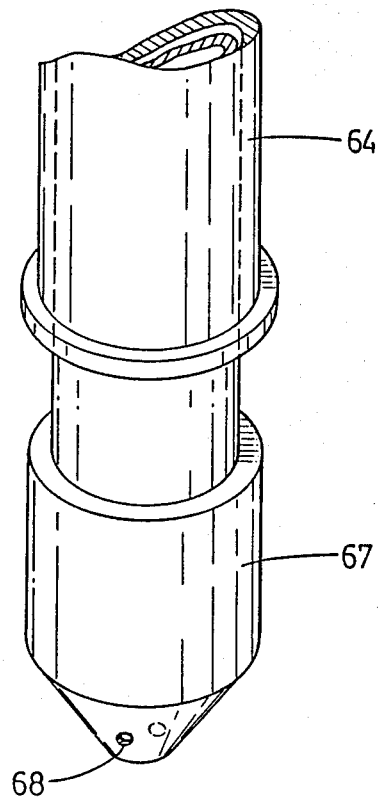
FIG. 8

METHOD AND APPARATUS FOR REMOVAL OF SURFACE MATERIAL

This application is a continuation-in-part of U.S. patent application Ser. No. 722,454, now Pat. No. 4,640,644 in the names of Ryszard Jan Puchala and Stephen John Miko assigned to Indescor Hydrodynamics Inc as filed Apr. 12, 1985 and entitled "METHOD AND APPARATUS FOR REMOVAL OF SURFACE MATERIAL".

THE NATURE OF THE INVENTION

The invention relates to a method and a device or apparatus using pressurized water for removing surface material such as concrete from various structures. In particular, the invention may be applied to remove old, unsound concrete from the surface of various concrete structures, leaving a sound concrete base upon which a new surface may be laid.

BACKGROUND OF THE INVENTION

From time to time, the surfaces of roads, highways, bridges, parking lots, dock walls and the like must be replaced. Constant exposure to traffic and weather limits the useful life of such surfaces and resurfacing is necessary. In many instances, a new surface cannot simply be applied to the old surface. In some instances, there may be a structure above the surface. In order to maintain a minimum predetermined clearance between such structure and such surface (for the passage of trucks and other vehicles, for example), the surface cannot be built up. Rather replacement is necessary. In other instances, the addition of a new surface on top of the old may increase the dead weight of the structure above its design capacity. In such an instance, replacement of the surface is necessary. As well, in most instances, a satisfactory bond between a sound old surface and the new surface is required.

In yet other cases, it may be desirable to build or join a new concrete structure to an old concrete structure. In order to ensure a strong connection therebetween, the old surface of the original structure may have to be removed.

Various methods and devices exist for removing a concrete surface from a concrete structure.

A common such device is a pneumatic jack hammer. Jack hammers suffer from numerous disadvantages when used to remove a large surface area. They make a substantial amount of noise and vibration, which may greatly inconvenience the public. A single jack hammer can only be effectively used to break up a relatively small surface. Consequently, a large number of hammers and human operators are needed to remove a large surface area within a reasonable amount of time. These labour and equipment requirements add significantly to the cost of the surface removal. An operator, being in close proximity to the hammer and to its dust and debris, may be exposed to health and safety hazards. Furthermore, jack hammers may damage, not only the substrate beneath the concrete surface, but also any reinforcing bars or mesh embedded in the concrete. Vibrations may damage neighbouring concrete structures that are sound and not intended for removal, for example, by causing micro-cracks which can then propagate through sound concrete to cause premature deterioration to be initiated.

Rotary cutters suffer from similar problems and in addition are subject to significant wear and are slow.

In order to overcome the above problems, devices using pressurized water have been proposed. In this specification, a pressure of less than 10,000 psi will be described as high pressure. A pressure between 10,000 and 25,000 psi will be described as extra or very high-pressure. A pressure above 25,000 psi will be described as ultra-high pressure.

In one such known pressurized water device, a stream of ultra-high pressure water essentially cuts or erodes away the concrete. Such devices are to be contrasted with those devices which use much lower pressures and which are only able to be used to clean and scour a surface. In a known concrete-removing device as, for example, disclosed in U.S. Pat. No. 4,081,200, water is pressurized to between 25,000 and 60,000 psi, that is to the ultra-high pressure range. In contrast, in the known concrete scouring devices, high pressures or even pressures up to about 15,000 psi have been used. Conventional devices have not generally been able to make use of extra-high pressures for the satisfactory removal of concrete.

In the known concrete-removing device, the ultra-high pressure water is passed through at least one small diameter nozzle to form a high energy water jet. Water jets developed from such ultra-high pressures may be sufficient to remove all structural concrete, both sound and unsound, to depths up to at least 3 inches.

In the system of U.S. Pat. No. 4,081,200, the jet nozzle was directed at a predetermined fixed angle, and traversed along an arcuate path. The jet was extremely fine and produced essentially a cutting action, removing a narrow, but deep portion of concrete. Broken concrete apparently created a problem, and the system was designed to progressively remove it. In order to use these ultra-high pressures, the nozzle was extremely fine, and located close to the work face.

The ultra-high pressures involved resulted in high kinetic forces sufficient to break up sound concrete. This, however, is not always necessary, or even desirable. Such a known device removed old concrete—both sound and unsound—leaving a generally level surface upon which new concrete could be poured. An important disadvantage of such known device is that significant time and energy may be wasted on the removal of sound concrete, when it may not be necessary to do so. Extra cost will then be incurred in replacing, unnecessarily, the sound concrete.

Another disadvantage is that the vehicle, upon which the ultra-high pressure device is mounted, must be advanced at a generally constant, yet slow, rate of speed, in most instances, a human operator would be unable to effectively control the vehicle speed for efficient concrete removal. Therefore, an expensive automatic speed controlling mechanism must be used.

Yet another disadvantage is that the nozzle assembly, which is only a fraction of the width of the vehicle, must be positioned at a particular location on its frame. During operation, the assembly is fixed relative to the vehicle. The nozzle assembly can generally only remove concrete from an area directly beneath itself. Consequently, concrete can only be removed across a fraction of the width of the vehicle.

In order to overcome the above disadvantages, it would be advantageous to provide a pressurized-water concrete-removing device suitable for removing essentially only unsound concrete from the surface of a concrete structure. Such operation would be analogous to the removal of a decayed area in a tooth by a dentist. Essentially, only the decayed or unsound portion would be removed, leaving only the sound material. A relatively small amount of sound material might incidentally be removed to ensure that all of the unsound material had been removed. Such operation would allow for increased speed of concrete removal and lower cost and yet provide a suitable substrate surface, upon which a new surface could be placed.

The ultra-high pressure concrete-removing device described above could conceivably be operated by hand to remove only unsound material, much like the manner in which a dentist manipulates his drill by hand. However, because of the difficulty and slow speed of manually identifying and removing all areas of unsound concrete, such operation would not be practical. Automatic operation is preferable, but automatic operation of the ultra-high pressure device removes all concrete down to a particular level.

It would, therefore, be advantageous to provide an automatic device which would treat both the sound and the unsound concrete in the same way at the same time.

Preferably such a device would traverse over good and bad concrete alike, and would remove all of the bad, but only minor portions of the good concrete.

In this way, when a new surface was applied, the quantity of new material required for resurfacing would be minimized. Also, the volume of loose, dislodged old material, which would have to be removed, would be minimized.

Preferably, the system would provide a degree of sweeping action or disruption which would carry dislodged material away from the work face. Kinetic forces would be sufficient to break up unsound concrete, while high volume flow rates in a disruptive flow pattern would effectively carry loose debris away from the immediate vicinity of the work face.

It would also be advantageous to provide a device which could also be operated manually, if so desired. While automatic operation is advantageous, it may be desired to use the device to remove only small, unconnected patches of unsound concrete. In such cases, manual operation of the device may be preferred.

It would also be advantageous to provide a concrete-removing device that allows a vehicle, upon which the device is mounted, to remain stationary or that requires it to be move only intermittently.

A further advantage would be obtained by providing for a nozzle assembly that traversed across at least a significant portion of the width of the vehicle.

A concrete-removing device using pressurized water and possessing the above advantages, of course, would also have all the advantages of a pressurized water system over standard pneumatic jack hammer or rotary concrete-removal devices.

It would further be advantageous to provide an apparatus or device which would be effective to break up unsound concrete beneath reinforcing bars embedded in such concrete so as to allow new replacement concrete to be introduced into the space below such reinforcing bars to ensure in turn the provision of adequate strength in the repaired structure. In this respect, it would also be advantageous if such an apparatus were also effective to clean all surfaces, including the undersurfaces, of such reinforcing bars, so as to ensure proper bonding of the new concrete material to those bars and to reduce, if not eliminate, the future deterioration of the replacement concrete as can be initiated by the presence of uncleaned and corroded reinforcing bars.

Yet another desirable feature of such an apparatus would be for it to be adaptable for the removal of unsound concrete material from sloping rampways such as are found, for example, between the different levels of indoor parking buildings.

A further desirable feature of such an apparatus would be for it to be usable for removing unsound concrete material from other non-horizontal surfaces. There may, for example, be mentioned the use of such an apparatus for removing unsound concrete material from the interior and exterior walls of buildings as well as in the treatment of dock walls and the walls of locks as provided in canal systems.

For speedier operation and further to avoid the risk of removing sound concrete material, it would be desirable to have an apparatus which could be programmed to treat an area of concrete work surface having an irregular outline in circumstances where it was established that only the concrete within such an irregular outline needed to be removed.

STATEMENT OF THE INVENTION

With a view to providing the above advantages, the invention comprises an apparatus for removing material from a work surface and for use in association with a source of water at a pressure within the range of from about 10,000 to about 25,000 psi, which apparatus comprises:

a support structure adapted to be stationarily disposed on a supporting surface;

extendible arm means mounted on said support structure for movement along a first linear path in a longitudinal direction away from and toward said support structure;

power-operated extension means attached to said support structure and to said arm means and operable to extend and retract said arm means relative to said support structure along said first linear path;

nozzle support means secured to said arm means at a position spaced apart from said support structure and extending transversely to said arm means in a transverse direction angularly oriented with respect to said longitudinal direction;

a rotatable nozzle means mounted on said nozzle support means for rotation about a nozzle axis angularly disposed with respect to the work surface and for movement along said nozzle support means in said transverse direction, at least one discharge orifice being provided in said nozzle means for the discharge of water under pressure therefrom in a direction angularly disposed with respect to said nozzle axis whereby water, on discharge from said nozzle means and on rotation of said nozzle means about said nozzle axis, defines an expanding cone-shaped configuration for impingement on the work surface;

a transverse nozzle drive means attached to said rotatable nozzle means and to said nozzle support means and adapted to move said rotatable nozzle means in both directions along a second linear path in said transverse direction with said nozzle means in spaced apart disposition relative to the work surface;

spacing means for maintaining said nozzle means at a desired separation from the work surface on operation of both said extension means and said transverse nozzle drive means; and control means operatively associated with said extension means and said transverse nozzle drive means to cause said transverse nozzle drive means to move said rotatable nozzle means alternately in opposite directions along said second linear path and to move said arm means along said first linear path so that water discharging from said nozzle means impinges the work surface in sequential transverse bands.

The invention further comprises a method for removing material from a work surface and which comprises the steps of:

pressurizing water to a pressure within the range of from about 10,000 to about 25,000 psi;

discharging said water under pressure through a movable and rotatable nozzle means supported on a stationary structure in turn disposed on a supporting surface, said nozzle means being spaced apart from said work surface and having at least one water discharge orifice disposed so that said discharge occurs in a direction angularly oriented with respect to an axis of said nozzle means;

rotating said nozzle means about said axis thereof whereby said water on said discharge from said nozzle means defines an expanding cone-shaped configuration impinging said work surface;

traversing said nozzle means relative to said stationary structure along a transverse linear path about extreme transverse positions so that said water discharging from said nozzle means impinges said work surface in a first transverse band;

longitudinally moving said nozzle means relative to said stationary structure along a longitudinal linear path angularly disposed with respect to said transverse linear path;

again traversing said nozzle means across said work surface along a said transvere linear path to define a second transverse band;

repeating said transverse and longitudinal movements of said nozzle means a predetermined number of time until the entire work surface has been treated; and maintaining said nozzle means at a predetermined distance from said work surface throughout the entire treatment of said work surface.

The invention achieves the aforementioned advantages in the following ways. First, water is pressurized to a pressure of between about 10,000 and about 25,000 psi, that is, to within the extra-high pressure range. A relatively high flow of pressurized water is passed through a relatively large diameter rotating nozzle. The water is formed into at least one rotating water jet. The rotating water jet is directed non-perpendicularly onto the concrete work surface to be removed. The rotating jet of water having an expanding cone-shaped configuration erodes and applies reactive pressure to the surface, sufficient to break up and remove unsound concrete. Satisfactory flow rates for the water have been found in the range of from about 60 to about 120 liters per minute. This is to be contrasted with U.S. Pat. No. 4,081,200 teaching a flow rate of about 30 liters per minute and pressures of 25,000 to over 60,000 psi. The apparatus of U.S. Pat. No. 4,081,200 may be operated to slowly remove all surface concrete—including both sound and unsound concrete—down to a particular level. However, the method and apparatus of the invention may be operated to remove generally only unsound concrete down to the same predetermined level. The sound concrete which remains will generally define an undulating surface, having bumps and hollows.

Second, the rotation of the water jet of the invention allows the removal of a circle of concrete, a typical diameter for such a circle being up to about 3.5 inches. Transverse movement of the nozzle apparatus allows a swathe or band of such width to be removed from the concrete. The rotational movement of the jet causes disruption and broken concrete material is washed away from the immediate vicinity of the work face and removed efficiently to the desired depth. The defective concrete material may sometimes be removed to the desired depth in only one transverse path of the nozzle apparatus having a suitable transverse speed. However, overlapping passes of the nozzle apparatus have proved to be particularly effective especially when unsound concrete is to be removed from beneath reinforcing bars, the undersurfaces of which must also be cleaned of old concrete residues to ensure proper bonding of the replacement concrete material and to prevent premature deterioration of such replacement concrete as a result of the presence of rust on such reinforcing bars.

Third, the nozzle apparatus is attached to one or more extendible arms. Upon completion of one transverse pass from side to side, the arm and the nozzle apparatus can be advanced or retracted an appropriate increment without moving the vehicle or other supporting structure on which the apparatus is mounted. Alternatively, the arm and the nozzle apparatus can possibly be continuously retracted or advanced at a very slow speed to ensure overlapping of transverse passes of the nozzle apparatus.

Fourth, the use of a rotating nozzle apparatus allows for a maximum length of transverse movement—essentially from one side of the supporting vehicle or structure to the other.

Normally, the supporting structure of an apparatus as provided by this invention will be in the form of a vehicle so that the apparatus can readily be moved from one location to another as required. In such an embodiment, the vehicle will be provided with immobilising means such as one or more lifting jacks to ensure stable positioning of the vehicle during the concrete-removal operation.

Sensors can be provided for sensing the height of the nozzle above the work surface as well as the lateral and longitudinal positions of that nozzle. Automatic controls can be provided to maintain optimum positioning, and rate of travel, for the rotating spray head. Various ways in which proper nozzle positioning and automatic control can be obtained will be described in greater detail hereinafter.

The various features of novelty which characterize the invention are pointed out with particularity in the claims annexed to and forming a part of this disclosure. For a better understanding of the invention, its operating advantages and the specific objects attained by its use, reference should be had to the accompanying drawings and descriptive matter in which there are illustrated and described preferred embodiments of the invention.

BRIEF DESCRIPTION OF THE DRAWINGS

FIG. 7 is a schematic diagram of an alternative control system as may be installed in an alternative embodiment of the apparatus of the invention;

FIG. 8 is an enlarged fragmentary perspective view of the nozzle head as may be installed on the apparatus shown in FIGS. 1 to 4;

DESCRIPTION OF THE PREFERRED EMBODIMENTS

Figure 1:
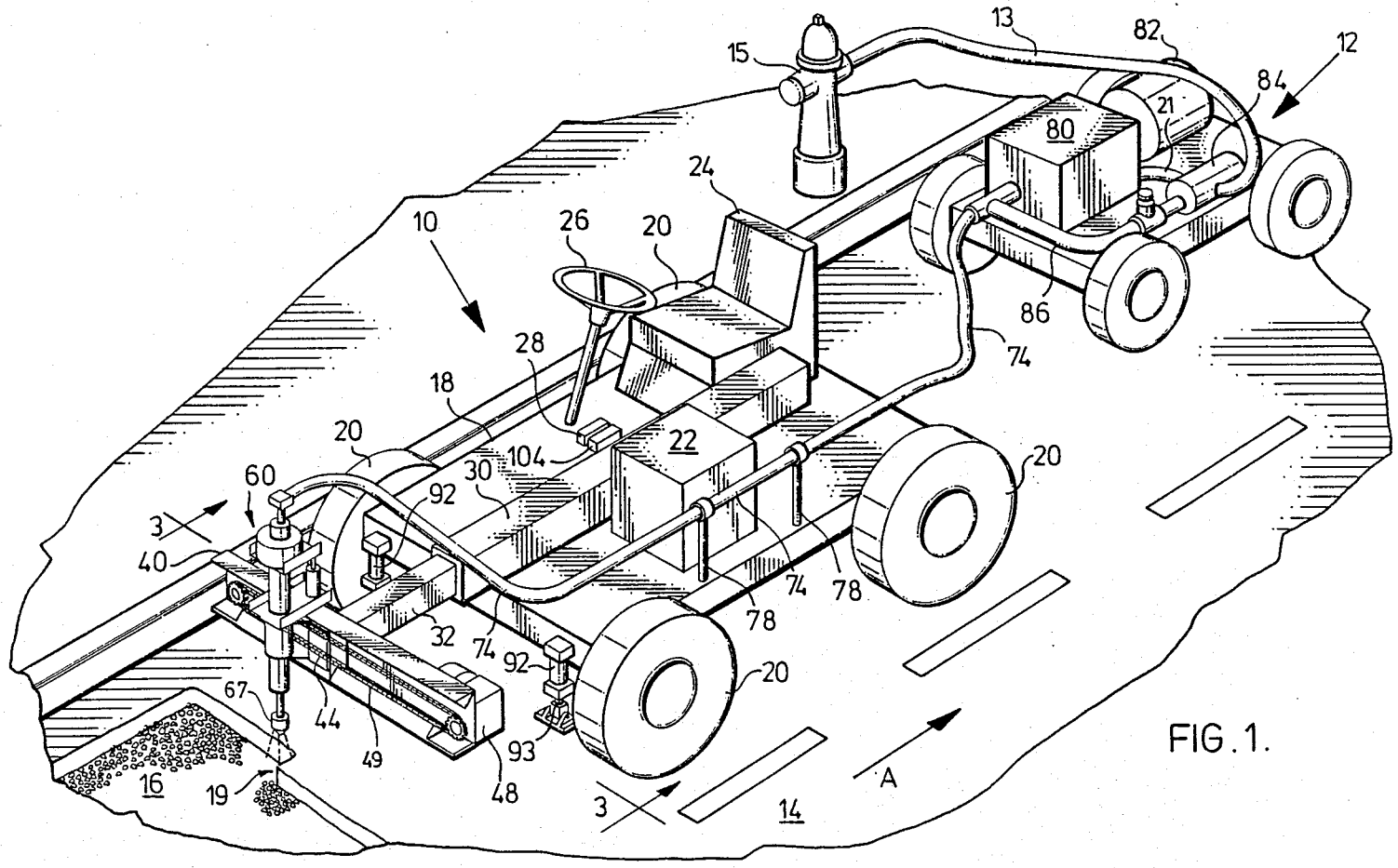
FIG. 1 is a perspective view of a vehicle on which there is mounted one embodiment of the apparatus of the invention.

Referring to FIG. 1, there is shown therein generally at 10 a concrete-removing vehicle 10 in accordance with the invention. Vehicle 10 is connected to a pumping vehicle 12. Concrete-removing vehicle 10 may tow pumping vehicle 12 or they may each be separate and independent vehicles. In certain situations, it may even be desirable to mount the necessary apparatus for both concrete removing and pumping operations on a single vehicle. In other situations, it is possible for pumping vehicle 12 to be remotely located from concrete-removing vehicle 10. Pumping vehicle 12 is connected by a hose 13 to any suitable source of water, such as hydrant 15. Vehicle 10 is illustrated as resting on old concrete road surface 14. Vehicle 10 removes concrete from old surface 14 in the direction generally indicated as A. When the old unsound concrete surface 14 has been removed by vehicle 10, as described below, a generally undulating substrate surface 16, of old yet sound concrete, remains in the wake of vehicle 10. Substrate surface 16 is generally left covered with rubble 17 (see FIG. 2), which is the broken up old surface 14. Rubble 17 may be subsequently removed by any suitable means such as by shovel or other means, to expose substrate surface 16. Of course, rubble 17 must be removed prior to laying a new concrete surface. As described below, rubble 17 is displaced from the immediate vicinity of work face 19 of old surface 14 during operation of the apparatus so as not to interfere with the concrete removal operation.

It will be appreciated that, although vehicle 10 is shown as reversing in the direction of arrow A, vehicle 10 could be operated equally well in a forward direction. In such a case, vehicle 10 would have to rest on substrate surface 16 or rubble 17 and point in the direction of arrow A.

Vehicle 10 comprises a chassis 18 to which are mounted wheels 20. Vehicle 10 is driven by a suitable motor 22, shown schematically, mounted on the chassis 18. Suitable transmission means (not shown) connect motor 22 to wheels 20. An operator (not shown) may sit at seat 24 on chassis 18. From this position, the operator may control vehicle 10 by means of a steering wheel 26 connected by suitable means to wheels 20 and vehicle controls 28, shown schematically.

All of the above components are well known in the art. They are described merely in order to be able to fully describe the invention and its operation. They are not intended to limit the invention in any way. Rather, it is intended that the scope of the invention cover any embodiment of the invention mounted to any suitable supporting structure, particularly a carriage vehicle.

Merely by way of illustration, it may be mentioned that it is equally possible within the scope of this invention to provide an apparatus in accordance therewith on any support structure which can be immobilised in a desired working position on a supporting surface, although, in general, it will be more practical for such a support structure to be in the form of a movable vehicle or carriage means. Furthermore, when such a support structure is in the form of a vehicle, it may be provided with a variety of wheel and steering systems. It is, for example, equally within the scope of this invention to provide such a vehicle with only three wheels, one or more of which may be steerable. Similarly, it is also possible for such a vehicle to be provided with continuous tracks rather than wheels and the motive power can, if desired, be provided as individual motors on the wheels instead of as a central motive power unit.

Referring now again to the vehicle 10 shown in FIGS. 1 to 4 of the accompanying drawings, it will be seen that extending forwardly from chassis 18 is a sleeve member 30. In the illustrated embodiment, sleeve member 30 defines a rectangular cross-section, although other shapes may be used. Slidably, or telescopically, received within sleeve member 30 is extension arm 32. Extension arm 32 rests upon slide pads 34 (see FIG. 3) mounted to the interior of sleeve member 30. A hydraulic cylinder 36 (see FIG. 2) is mounted to sleeve member 30. An operating rod 38 of cylinder 36 is affixed to extension arm 32, whereby operation of hydraulic cylinder 36 will cause extension arm 32 to either extend from or retract into sleeve member 30, as desired.

Extension arm 32 defines a forward end to which is transversely mounted a nozzle support member 40 in spaced apart disposition with respect to the vehicle 10.

Figure 4:
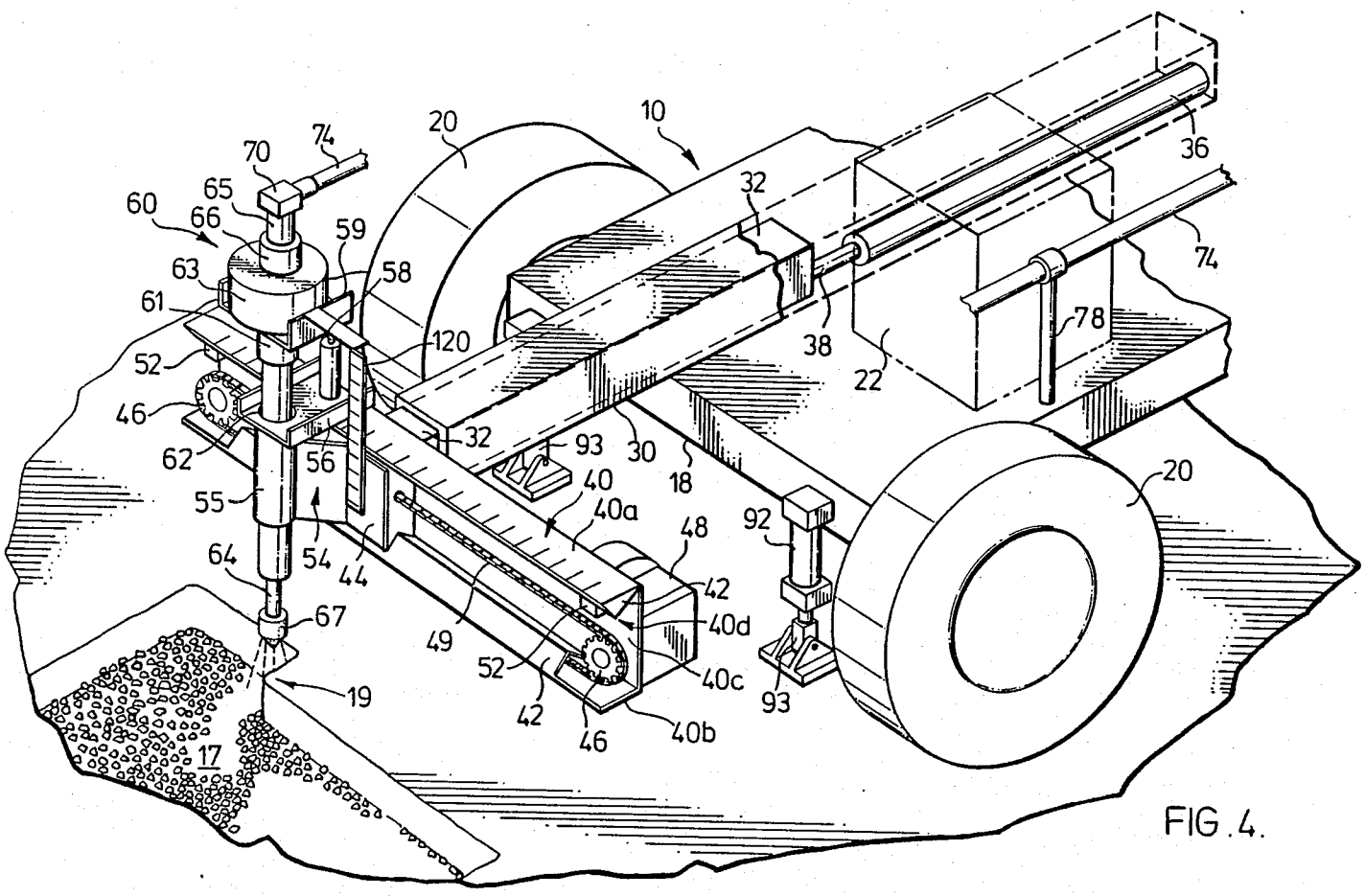
FIG. 4 is a close-up perspective view of a front portion of the vehicle of FIG. 1.

Referring to FIG. 4, nozzle support member 40 preferably defines a generally channel-shaped cross section, having upper and lower flange members 40*a* and 40*b* joined by web 40*c* and defining channel 40*d* therebetween. Bearing blocks 42 are mounted to flanges 40*a* and 40*b* facing inwardly within the channel 40*d*. Head support block 44 is slidably mounted between bearing blocks 42. Adjacent each end of nozzle support member 40, there is rotatably mounted a sprocket 46, one of which is coupled to a sprocket drive means 48, which may be a hydraulic motor. Motor 48 may be affixed to the rear side of web 40*c* and connected to sprocket 46 by a suitable shaft (not shown). A suitable chain 49 is entrained around the sprockets 46 and is terminally connected to head support block 44.

It will be appreciated that, although a motor/sprocket/chain mechanism has been illustrated for driving the head support block 44 from side to side, other suitable transverse driving mechanisms may be used.

Also limit switches such as 52 are located adjacent the ends of nozzle support member 40. An electrical signal from either of limit switches 52 may be used to control the operation of motor means 48, whereby to prevent further transverse motion of head support block 44 past the limit switch 52. The electrical signal from limit switch 52 may also be used to initiate by suitable electrically activated actuator means (FIG. 7), an incremental movement of extension arm 32.

It will be appreciated that limit switches 52 may be movably mounted by suitable mounting means (not shown) on support member 40. Adjustment of the positioning of limit switches 52 will thus set the limits of the transverse movement of head support block 44.

Referring to FIG. 7, the signal from a limit switch 52 may be used in two ways. First, the signal may be delivered to a reverse or stop means 51. Reverse or stop means 51, upon receipt of such a signal, is operable to either reverse the direction of or to stop motor 48, as may be pre-selected by the operator. Second, the signal from limit switch 52 may be delivered to an extension actuator means 53, operable upon receipt of such a signal to extend (or retract, as desired) extension arm 32 a suitable pre-determined increment. Such extension operation is achieved by connecting extension actuator means 53 to hydraulic cylinder 36.

Mounted to head support block 44 is nozzle support frame 54. Support frame 54 includes a generally vertical cylindrical sleeve member 55, mounted to block 44 forwardly of nozzle support member 40, and a cantilever arm 56. Cantilever arm 56 is attached to cylindrical sleeve member 55 and extends rearwardly above upper flange 40*a*. A hydraulic cylinder 57 is mounted to cantilever arm 56 and extends upwardly. An operating rod 58 of hydraulic cylinder 57 is fixed to nozzle holder member 59 of a nozzle assembly generally indicated at 60.

The nozzle assembly 60 includes a tubular housing 61 which is secured to the nozzle holder member 59. Housing 61 extends downwardly from nozzle holder member and is slidably mounted within cylindrical sleeve member 55. Suitable bearing or bushing means indicated at 62 but not shown in detail may be provided to permit vertical movement of the nozzle assembly 60.

Nozzle assembly 60 includes a nozzle motor means 63, which in the illustrated embodiment is a hydraulic motor. Nozzle motor 63 is operable to rotatably drive hollow nozzle shaft 64, which is rotatably mounted within housing 61. The hollow interior of shaft 64 is in communication with an inlet manifold 65 through a suitable rotating seal means or coupling 66. The lower end of the shaft 64 extends outwardly of the bottom of housing 61 and is connected to a nozzle head 67. Nozzle head 67 includes at least one nozzle discharge orifice 68 (FIG. 8). Nozzle head 67 is oriented more or less vertically for rotation about a vertical axis while nozzle orifice 68 is angularly disposed with respect to the vertical or rotational axis so that water discharges downwardly therefrom in an expanding generally cone-shaped configuration. Nozzle orifice 68 is in communication via the hollow interior of shat 64 with the inlet manifold 65.

A suitable inlet fitting 70 is attached to inlet manifold 65 for introducing extra-high pressure water thereinto.

In the illustrated embodiment, extra-high pressure water is introduced into nozzle assembly 60 by hose 74. Hose 74 is connected by fitting 70 to nozzle assembly 60. Hose 74 passes back towards chassis 18 along extension arm 32 and sleeve member 30. Hose 74 is sufficiently long so that extension arm 32 may extend fully without damaging or interfering with hose 74. However, hose 74 is not so long that it will drag on surface 14 when extension arm 32 is in the fully retracted position. Alternatively, suitable hose support means (not shown) may be provided to prevent hose 74 from touching the ground when arm 32 is in the retracted position. Hose 74 passes rearwardly above the chassis 18. Hose 74 may be supported in a predetermined position by hose support members 78. Hose 74 extends rearwardly from vehicle 10 to pumping vehicle 12. Throughout its length, hose 74 may be comprised of various sections joined by suitable union means.

Pumping vehicle 12 includes an extra-high pressure pump 80, driven by suitable motor means 82, which may conveniently be an internal combustion engine. The inlet of pump 80 is connected by hose 21 to a header tank 84, which is in turn connected to a suitable source of water, such as hydrant 15. A bypass hose 86 connects the pump outlet back to header tank 84. The outlet of pump 80 is connected to hose 74. Suitable valve means (not shown) control the flow of water from hydrant 15 to tank 84, and from the pump outlet, to hose 74, or to bypass hose 86. In this way, the pump motor 82 can be run continuously while water discharge from the nozzle head 67 is operated intermittently, as required, without damage to the pump and motor.

Hydraulic cylinders or jacks 92 are affixed to chassis 18 of vehicle 10 adjacent each wheel 20. Hydraulic cylinders 92 are oriented in an essentially vertical direction, whereby extension of an operating arm 93 of a cylinder 92 may operate to a jack a wheel 20 off of road surface 14 (see FIG. 3) and so immobilise the vehicle 10.

Figure 5:
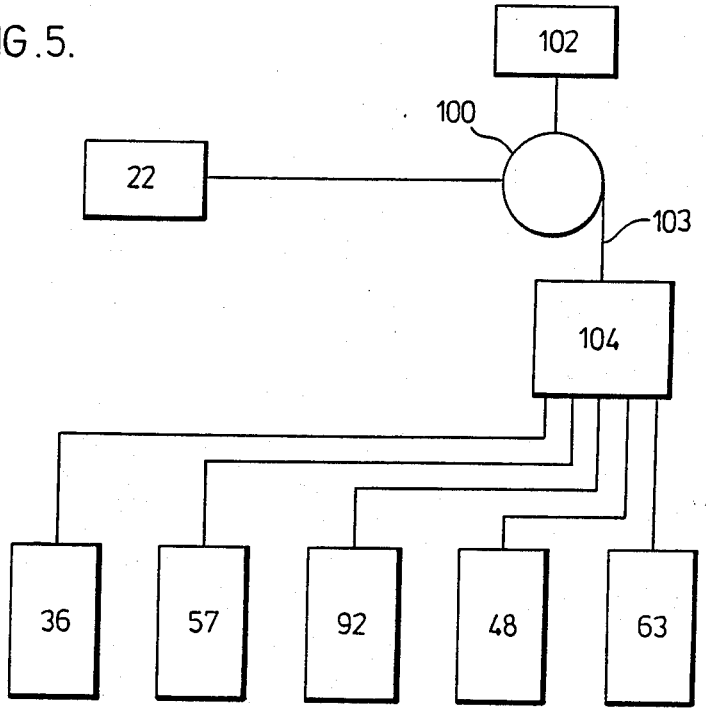
FIG. 5 is a schematic diagram of the hydraulic system of the vehicle of FIG. 1.

Referring to FIG. 5, vehicle motor 22 includes a suitable power take off means (not shown) connected to a hydraulic pump 100. The intake of pump 100 is connected to a reservoir 102, containing a suitable hydraulic fluid. The outlet of pump 100 is connected by suitable hydraulic lines 103 to each of hydraulic cylinders 36, 57 and 92 as well as to hydraulic motors 48 and 63. Suitable controls, indicated schematically as 104, are provided to allow the operator to individually control the operation of hydraulic cylinders 36, 57 and 92 as well as motors 48 and 63.

Figure 2:
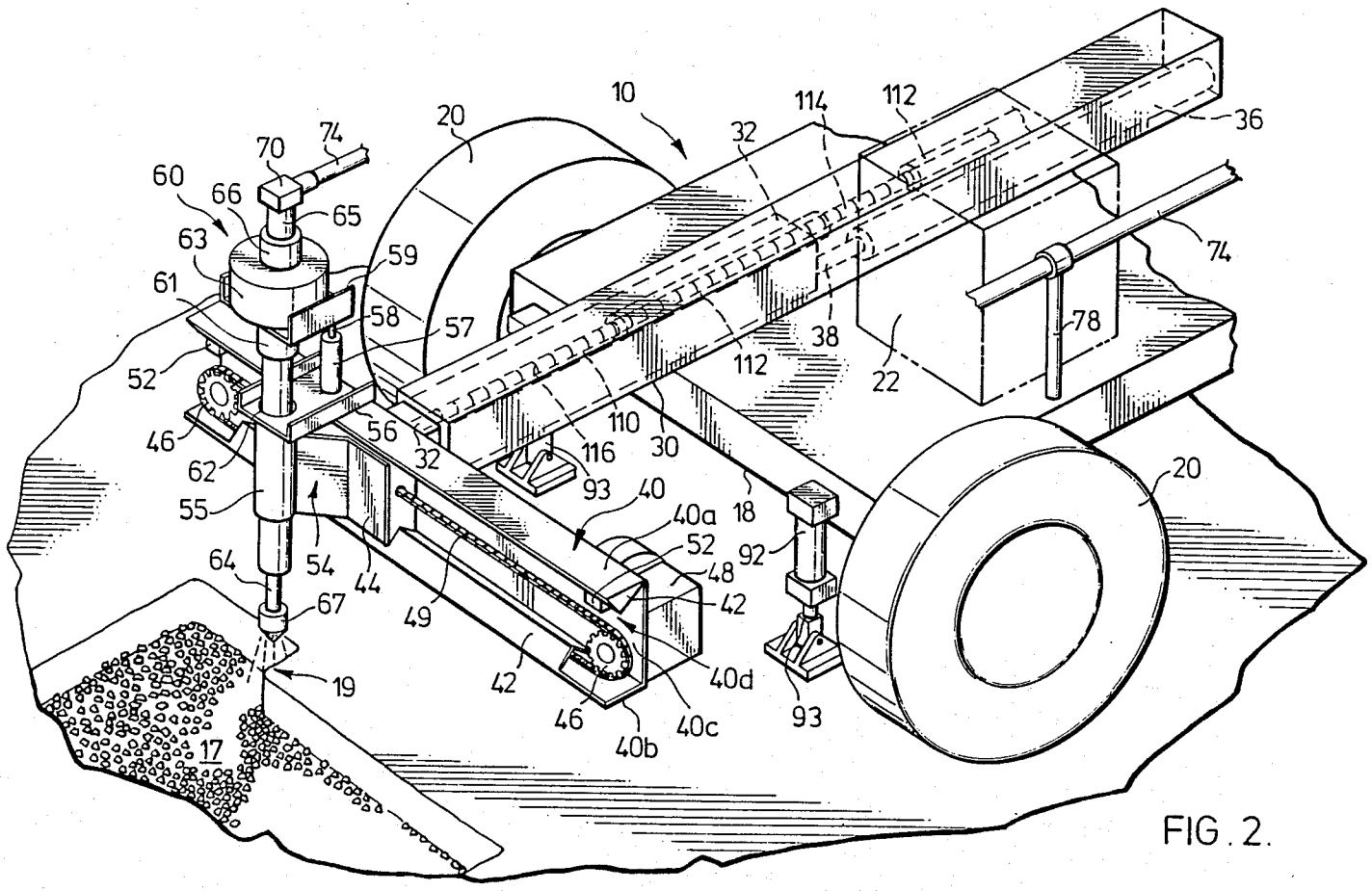
FIG. 2 is a close-up partially cut away view in perspective of the front portion of the vehicle of FIG. 1.
Figure 3:
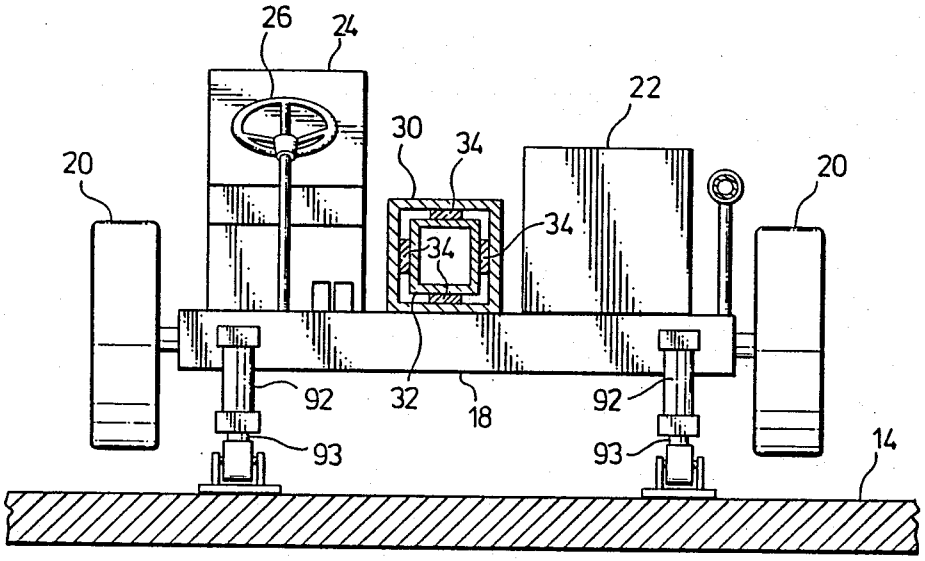
FIG. 3 is a cross-section along the line 3—3 of FIG. 1.

Suitable indicators are provided so that the position of the nozzle head 67 with respect to work face 19 may be easily identified by an operator. In the illustrated embodiment, a graduated rod 110 (shown only in FIG. 2 is mounted to nozzle support member 40. Rod 110 extends rearwardly adjacent sleeve member 30. Rod 110 extends through and is supported by, but freely slidable within, a sleeve 112. Sleeve 112 defines a gap or aperture 114 through which graduation marks 116 marked on rod 110 may be conveniently viewed by an operator. Marks 116 are conveniently placed at a distance corresponding to the width of the swathe cut by extra-high pressure water issuing from nozzle head 67, as described below. It will be appreciated that other indicator means may be used to indicate the position of extension arm 32 relative to sleeve 30.

Similarly, the vertical position of nozzle assembly 60 relative to nozzle member 40 may be conveniently measured. For this purpose, there is shown only in FIG. 4, a graduated L-shaped measuring arm 120, mounted to housing 61 or to nozzle holder member 59, and extending downwardly past nozzle support frame 54. The vertical position of the nozzle head 67 may then be determined by observing the graduation marks, as they pass the top of nozzle support member 40 or some other suitable pointer fixed relative thereto. Again, it will be appreciated that other indicator means may be used to indicate the vertical position of nozzle head 67 relative to nozzle support member 40.

The transverse position of the nozzle head 67 may simply be determined by observing the position of nozzle assembly 60 or of cantilever arm 56 relative to nozzle support member 40. The top of member 40 may be provided for this purpose with suitable graduation marks as shown only in FIG. 4. Other indicator means may be used.

Figure 6:
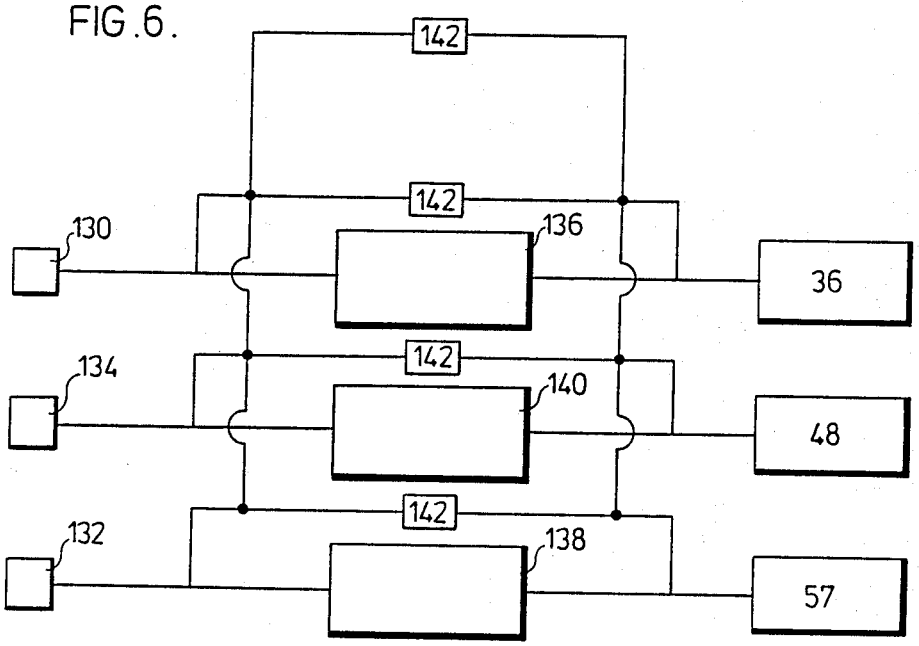
FIG. 6 is a schematic diagram of an automatic control system as may be installed in one embodiment of the apparatus of the invention.

It will also be appreciated that with suitable position transducers and controller means, the operation of the concrete-removing operation may be fully automated. FIG. 6 schematically illustrates generally such an automatic system. Position transducers 130, 132 and 134 provide signals, electrical or otherwise, regarding the extension position of arm 32, the vertical position of nozzle 67 and the transverse position of nozzle 67, respectively. Such signals are respectively delivered to extension position controller means 136, vertical position controller means 138 and transverse position controller means 140. Controller means 136, 138 and 140 are connected respectively to hydraulic cylinder 36, hydraulic cylinder 57 and hydraulic motor 48. Suitable manual override means 142 may also be provided to manually override controller means 136, 138 and 140, whereby a human operator is able to manually control the position of the nozzle head 67 regardless of its actual position.

In operation, the vehicle is positioned over the work face, and the jack cylinders 92 are operated to raise wheels 20 off the supporting road surface 14 and to immobilise the vehicle 10. Extension arm 32 typically will be extended to its forwardmost position. Nozzle support block 44 will be located at one end of nozzle support member 40. Water is introduced into pump 80 from hydrant 15 through hose 13. Motor 82 is set to run steadily at a predetermined speed. Pump 80 pressurizes the water into the extra-high pressure range. Extra-high pressure water passes from pump 80 through hose 74 to nozzle assembly 60. The extra-high pressure water passes through nozzle discharge orifice 68 of nozzle head 67, thereby defining a jet of extra-high pressure water. In this particular embodiment, such jet is angularly disposed with respect to the vertical axis. Motor means 63 operates to rotate nozzle head 67 about the vertical axis. The jet, therefore, traces out a generally conical shape. The jet strikes the old road surface 14 in a generally circular configuration and applies erosion and reaction forces thereto. Such forces are sufficient to cut or dislodge old unsound concrete, leaving most of the sound concrete undisturbed. Such an arrangement has been found to be sufficient to generally remove all old unsound concrete lying within the cone of the jet, typically a circle or swathe of concrete about 3.5 inches across. The disruptive rotating action of the jet clears dislodged old material from the immediate vicinity of work face 19, so that the jet is applied directly on the work face, and not onto stationary loose material.

In certain embodiments, it may be desired to have more than one discharge orifice 68 and possibly then to have one of the nozzle orifices discharging in a vertical direction so that it traces out a cylindrical shape, which may have advantages in particular situations.

According to the age and constituent parts of the particular concrete, motor 48 is set at and acts at a predetermined speed. Motor 48 operates to cause nozzle assembly 60 to move transversely along nozzle support member 40. The transverse speed of nozzle apparatus 60 defines a predetermined rate to ensure that all old unsound concrete extending to a particular depth below surface 14 can be removed. Accordingly, in one transverse scan from one side of nozzle support member to the other side of nozzle support member 40, all such old unsound concrete may be removed to the desired depth. Alternatively, if for any reason such operation should not be practical, the concrete may be removed to the desired depth with two or more scans.

As nozzle assembly 60 moves transversely along nozzle support member 40, it will contact a limit switch 52 at one end of nozzle support member 40. If another scan along the same path is to be performed, the electrical signal from limit switch 52 may be delivered to the reversing means 51 (FIG. 7) for reversing the operation of motor 48. However, if only one scan is required, the signal from limit switch 52 may be delivered to a suitable stop means 51 for stopping transverse motion and to an extension actuator means 53 for actuating hydraulic cylinder 36. Similarly, when the nozzle assembly 60 reaches the other end of nozzle support member 40, the other limit switch 51 may operate it in corresponding fashion.

When one (or more) transverse scans has been completed, hydraulic cylinder 36 is operated to retract extension arm 32 a pre-determined increment related to the maximum width of concrete removed in the previous scan or scans. Such operation may be achieved manually, upon receipt by the operator of information that the desired scans have ben completed, or extension actuator 53 may be provided for the automatic operation of hydraulic cylinder 36.

The nozzle support head 44 is again traversed to achieve a scan or scans over the new work, again removing old unsound concrete and leaving as far as possible, sound concrete, in place.

The extension arm 32 is again moved a predetermined increment, and the operation continues until the extension arm is fully retracted. Clearly, the operation can also be commenced with the arm 32 fully retracted and it can be progressively extended, if desired. In either case, the vehicle remains stationary during operation of the water jet.

When extension arm 32 has been either fully extended or fully retracted (depending on whether the vehicle is being operated in a forward or reverse direction), hydraulic cylinders 92 are operated to lower vehicle 10 to road surface 14. The extension arm 32 is again extended (or retracted, as the case may be) to its starting position. The operator then drives vehicle 10 to a new position so that the nozzle 67 is located to continue removing concrete from the work face 19 at the point where it left off. Hydraulic cylinders 92 are operated again to raise vehicle 10 off road surface 14. Operation then continues until the desired amount of concrete has been removed.

Throughout these operations, pump 82 and motor 80 may run continuously. Flow of extra-high pressure water will be controlled by the operator so as to flow either to nozzle head 67 or through bypass hose 86 back to header tank 84.

In automatic operation, position transducers 130, 132 and 134 operate to deliver position signals regarding nozzle head 67 to extension controller 136, vertical controller 138 and transverse controller 140, respectively. When appropriate, controllers 136, 138 and 140 will cause the adjustment of or increment the position of nozzle head 67 accordingly.

It will be appreciated that suitable shroud means could be provided around the nozzle head 67 to prevent loose rock and debris from flying about the work site, and to reduce noise.

Although the invention has been described in relation to the removal of concrete surfaces, it will be understood that the inventive principles may be equally applied to other surfaces, such as rock, asphalt or other surfaces.

Figure 9:
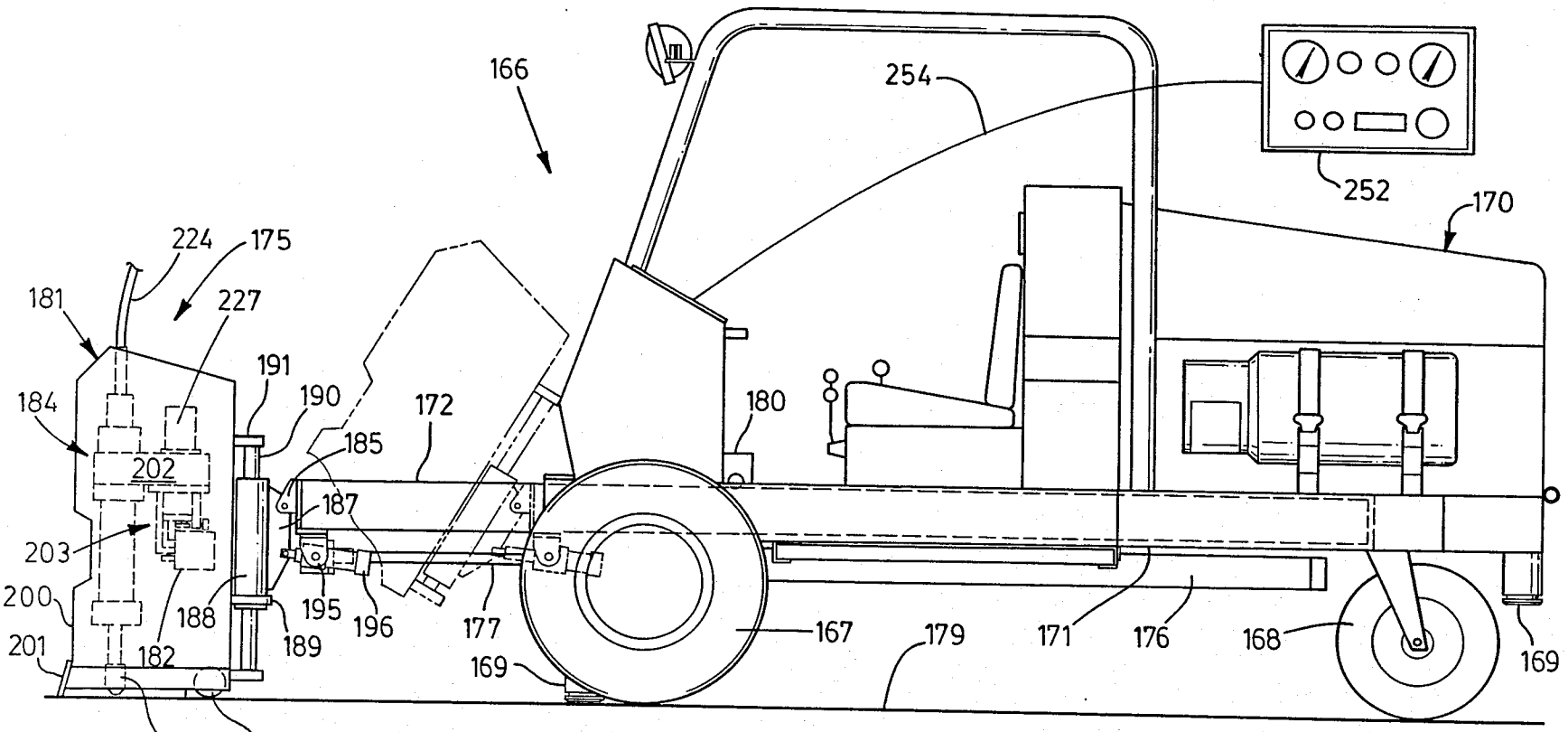
FIG. 9 is a side elevation of a vehicle on which there is mounted an alternative embodiment of the invention.
Figure 10:
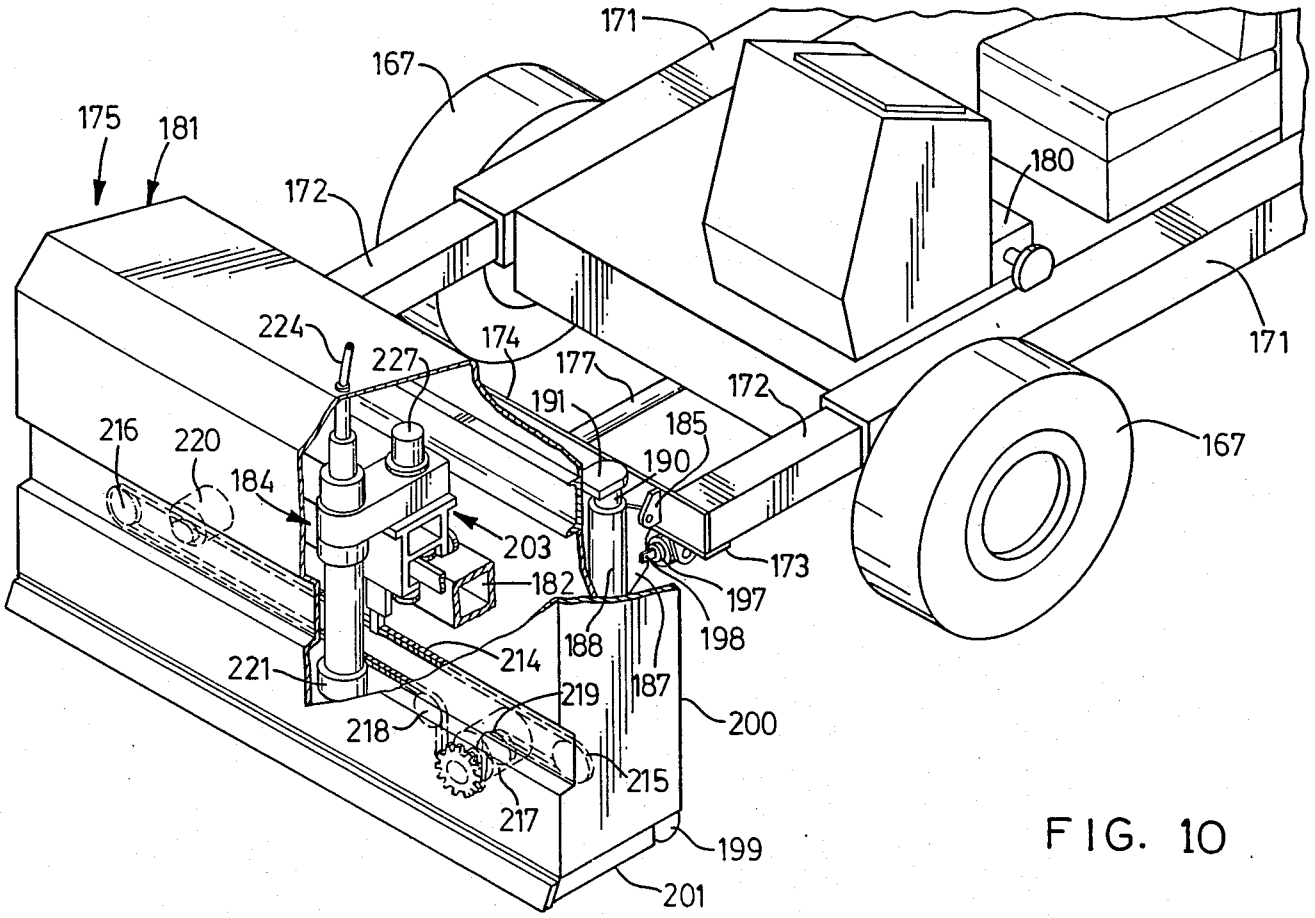
FIG. 10 is an enlarged perspective view of a front portion of the vehicle shown in FIG. 9.
Figure 11:
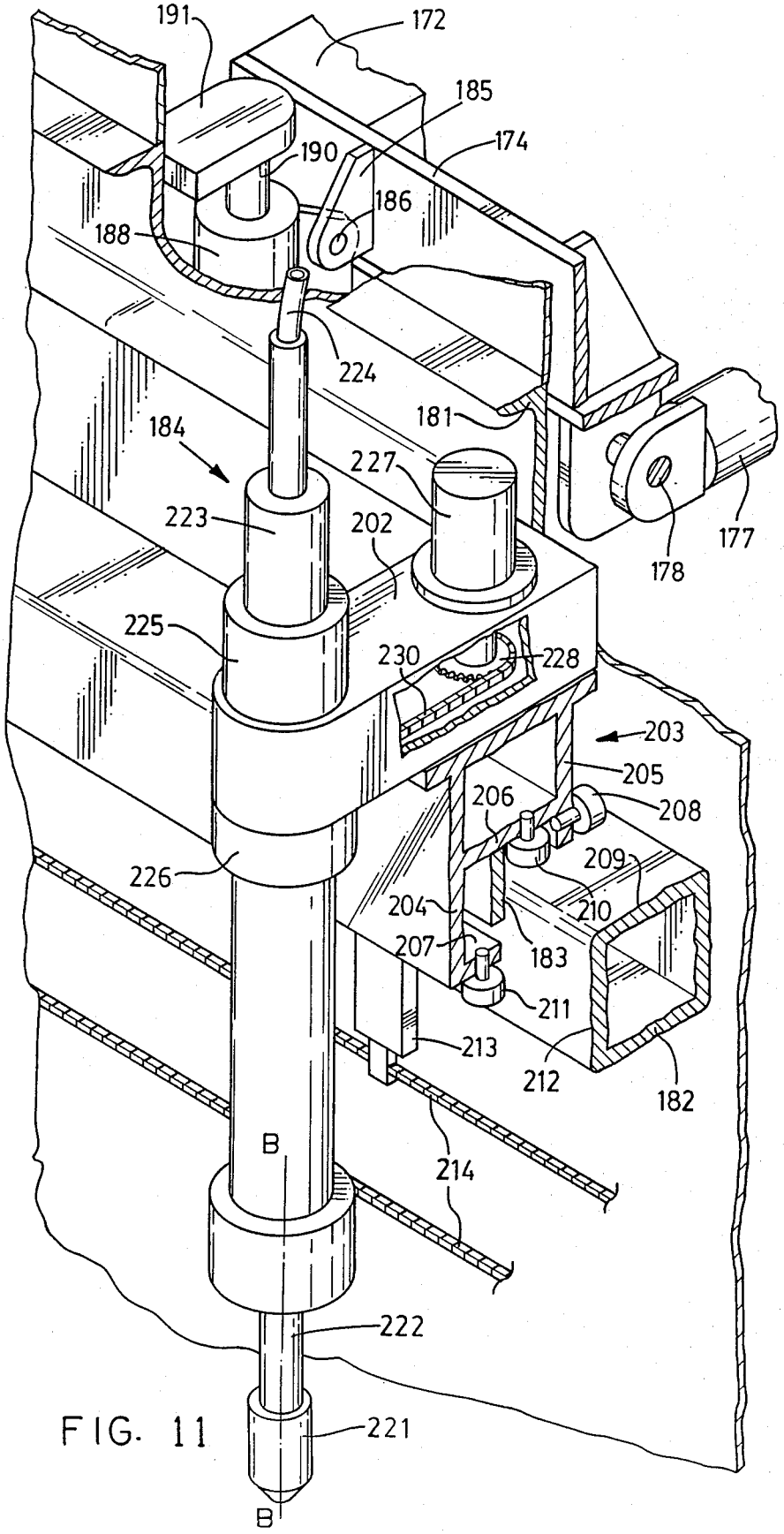
FIG. 11 is an enlarged perspective view of a nozzle support means provided on the vehicle shown in FIGS. 9 and 10.

Reference will now be made to FIGS. 9, 10 and 11 of the accompanying drawings in which there is indicated generally at 166 an alternative embodiment of a vehicle constructed in accordance with this invention. The vehicle 166 has front wheels 167 and rear casters 168 by means of which the vehicle 166 can be steered in a conventional manner. The vehicle 166 is provided in the manner already described with hydraulic jacks, omitted from FIG. 10 and two of which are shown in FIG. 9 at 169. The vehicle 166 is powered by an engine generally indicated at 170.

The vehicle 166 also comprises a chassis which includes two sleeve members 171 extending in the longitudinal direction along opposite sides of the vehicle 166. Slidably disposed in the sleeve members 171, there are provided extension arms 172 which are interconnected at their forward ends by a horizontal transverse member 173 and by a vertical transverse member 174.

There is mounted on the vertical transverse member 174 in a manner yet to be explained a transversely extending nozzle-support assembly generally indicated at 175. A hydraulic cylinder 176 is mounted on the chassis of the vehicle 166 and a piston rod 177 of that cylinder is connected at 178 to the vertical transverse member 174 so as to move the extension arms 172 and the nozzle-support assembly 175 between the extended position shown in solid lines in FIG. 9 and a retracted position shown in phantom outline in that same figure. Means yet to be described are also provided for elevating the nozzle-support assembly 175 relative to the roadway or supporting surface 179 and for tilting the nozzle-support assembly 175 into the tilted retracted position shown in phantom outline in FIG. 9.

A rotary encoder 180 driven by movement of one of the extension arms 172 provides an operating signal indicative of the position of the nozzle-support assembly 175 relative to the vehicle 166 in a first or longitudinal direction.

The nozzle-support assembly 175 comprises a housing generally indicated at 181 forming part of which is a transversely extending tubular member 182 formed in turn with an upstanding flange 183.

A nozzle assembly generally indicated at 184 is mounted on the nozzle-support assembly 175 for movement in a second or transverse direction relative to the vehicle 166 as will be explained in greater detail as the description herein proceeds.

Transversely spaced apart lugs 185 are provided on the vertical transverse member 174 and these lugs 185 are pivotally connected at 186 to flanges 187 provided for this purpose on respective vertical control hydraulic cylinders 188 which are slidably received in ears 189 fixed to and projecting rearwardly from the nozzle-support assembly 175. Rods 190 of these cylinders 188 are connected as indicated at 191 at their upper ends to the nozzle-support assembly 175.

Lugs 195 depending from the horizontal transverse member 173 pivotally support tilt-control hydraulic cylinders 196 having piston rods 197 which are in turn pivotally connected at 198 to respective ones of the flanges 187 as will best be understood by reference to FIG. 10.

The nozzle-support assembly 175 is provided at each of its transverse sides with a freely rotatable road-engaging caster 199 and is enclosed within a cover 200 carrying about its lower edge a skirt 201 of rubber or other suitable flexible material to protect personnel from flying debris during operation of the apparatus.

Referring now more particularly to FIG. 11 of the accompanying drawings, it will be seen that the nozzle assembly 184 is supported by a cantilever arm 202 which is in turn secured to a transverse carriage generally indicated at 203 and which in turn comprises vertical legs 204 and 205, horizontal web 206 and horizontal flange 207. A pair of transversely spaced apart rollers 208 are rotatably mounted on leg 205 of carriage 203 so as to ride along the top surface of an upper web 209 of the tubular member 182. Similarly, a pair of transversely spaced apart rollers 210 are rotatably mounted on the horizontal web 206 for rolling engagement with the upstanding flange 183. A pair of transversely spaced apart rollers 211 are similarly rotatably mounted on the horizontal flange 207 for rolling engagement with the front web 212 of the tubular member 182.

It will now be understood that the carriage 203 is free to move along the tubular member 182 between the extreme transverse limits of the nozzle-support assembly 175.

To effect such transverse movement of the carriage 203, that carriage is provided with a leg 213 to which are secured the ends of a chain 214 which is entrained about sprockets 215 and 216 positioned at opposite transverse ends of the nozzle-support assembly 175. The chain 214 is driven by a hydraulic motor 217, guide sprockets 218 and 219 being provided in a conventional manner as will be readily understood by reference to FIG. 10. A rotary encoder 220 is driven by chain 214 to provide a signal indicative to the transverse position of the nozzle assembly 184.

Within the nozzle-support 175, there is, as already indicated, provided a nozzle assembly 184 in turn comprising a nozzle head 221 carried on the lower end of a hollow shaft 222 which communicates through a coupling 223 with a high pressure water supply hose 224. Bushings 225 and 226 allow rotation of the shaft 222 about an axis B—B while a hydraulic motor 227 is supported on the arm 202 to cause rotation of the hollow shaft 222 through a drive system comprising sprocket 228 and chain 230.

It will be understood that the hydraulic cylinders 188 are operatively effective to raise and lower the nozzle-support assembly 175 moving the casters 199 into and out of contact with the road surface 179 on which the vehicle 166 is positioned. Since the vertical position of the nozzle head 221 is fixed relative to the casters 199, engagement of those casters 199 with the road surface 179 serves to maintain the nozzle head 221 at a fixed predetermined distance above the road surface 179. During operation of the apparatus, the cylinders 188 serve as a biassing means maintaining the casters 199 in contact with the road surface 179. It will now also be understood that operation of the cylinders 196 causes partial rotation of the nozzle-support assembly 175 from the vertical position shown in solid lines in FIG. 9 to the tilted position shown in phantom outline in that same figure. It will further be understood that the cylinders 188 as well as the cylinders 196 will be provided with hydraulic hoses (not shown) for the supply and discharge of hydraulic fluid to effect such elevation/lowering and tilt operations. Similarly, hydraulic hoses (not shown) will extend to the cylinder 176 controlling extension-retraction of the arms 172 in the sleeve members 171.

The nozzle head 221 will be provided with one or more water discharge orifices which will be angularly disposed with respect to the longitudinal axis B—B about which the nozzle head 221 rotates. The rotation of the nozzle head 221 is obtained by the provision of the hydraulic motor 227. Alternatively, it is also possible to obtain the desired rotation of the nozzle head 221 by disposing the water discharge orifices in that nozzle angularly with respect to radii thereof so that the water discharge in itself automatically causes rotation of the nozzle in the same manner as rotation is automatically obtained by water discharge in garden lawn sprinklers.

The vehicle 166 is operated in essentially the same manner as the vehicle 10 previously described. For such use, the vehicle 166 is positioned over the roadway surface 179 and the jacks 169 are operated to raise the wheels 167 and casters 168 off the road surface 179. Extension arms 172 are then typically extended to their forwardmost positions. Extra-high pressure water is then fed to the nozzle assembly 184 by a hose 224 and such extra-high pressure water discharges as at least one high pressure water jet from the nozzle head 221. Rotation of the nozzle head 221, either automatically as a result of such water discharge or by the use of a separate nozzle motor means such as the motor 227, causes the discharged water to have a conical configuration radially expanding in the downward direction and to impinge the road surface 179. It will be understood that, provided the axis B—B is perpendicular to the road surface 179, the jet discharge impinging that road surface will have a generally circular configuration. Otherwise, the impingement area will have an elliptical configuration. Operation of the nozzle transverse drive system causes the nozzle assembly 184 to traverse the roadway surface 179 from one side of the apparatus to the other. When one or more such transverse scans has been completed, the previously mentioned hydraulic cylinder 176 is operated to retract the nozzle-support assembly 175 a predetermined distance or increment in a manner which should be readily understood from the previous description of the operation of the embodiment shown in FIGS. 1 to 4 and as will be considered in greater detail hereinafter.

Operation of the several hydraulic controls referred to in the foregoing description can be automatic or manual. For this purpose, the vehicle 166 is provided with a microprocessor control operated from a console or panel indicated schematically at 252 which can be positioned actually on the vehicle 166 or removed therefrom to permit remote control as shown in FIG. 9. For this purpose, the panel 252 is connected to the vehicle controls by a cable indicated schematically by the line 254. In this way, if desired, an operator can step down from the vehicle 166 and observe the operation of the nozzle and control the function from any position while standing on the roadway 179.

Further details of the manner in which the vehicle 166 can be operated automatically will be provided as the description herein proceeds. At this juncture, it can, however, be mentioned that the output signals from the rotary encoders 180 and 220 will provide input to such microprocessor control system.

Figure 12:
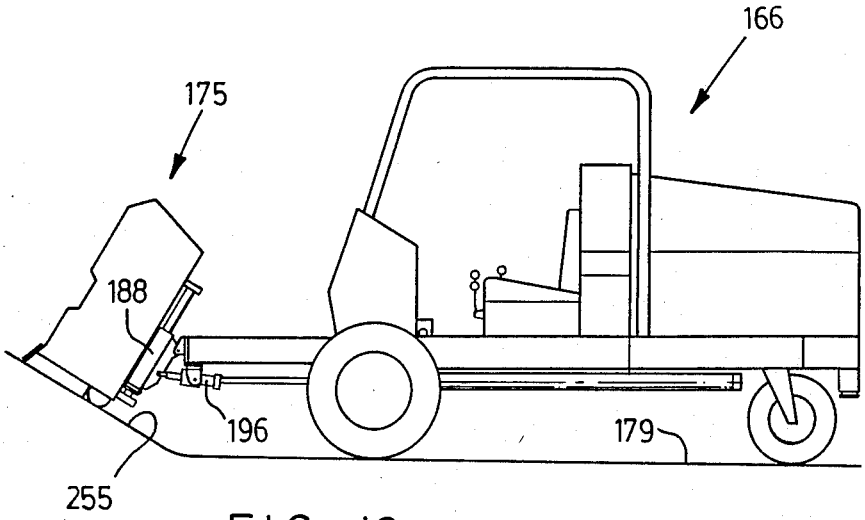
FIG. 12 is a somewhat schematic illustration showing one way in which the vehicle shown in FIG. 9 can be used.
Figure 13:
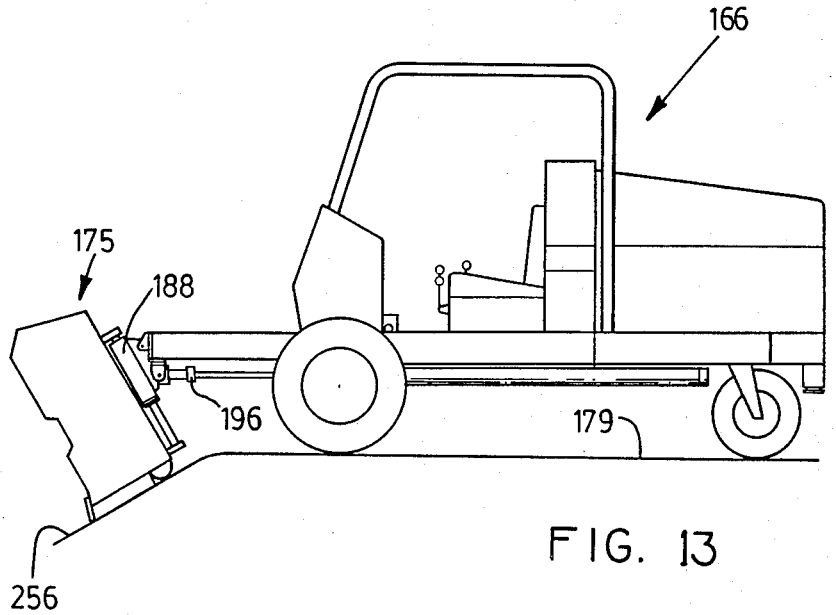
FIG. 13 is a somewhat schematic illustration showing yet another way in which the vehicle of FIG. 9 can be used.

Reference will now be made to FIGS. 12 and 13 of the accompanying drawings which show how the vehicle 166 can be used to remove material from a sloping roadway surface. For example, in FIG. 12, the vehicle 166 is shown as being disposed on a generally horizontal roadway or supporting surface 179 with the nozzle-support assembly 175 disposed over an upwardly sloping ramp or work surface 255 from which unsound concrete material is to be removed. Similarly, in FIG. 13, the vehicle 166 is shown as being positioned on the same generally horizontal roadway 179 with the nozzle-support assembly 175 disposed over a downwardly sloping ramp or work surface 256. It will be appreciated that such orientation of the nozzle-support assembly 175 is made possible by operation of the tilt control cylinders 196 in conjunction with operation of the elevation-lowering control cylinders 188. This feature is especially advantageous when the vehicle is used to remove old and unsound concrete material in multi-level buildings such as motor vehicle parking buildings in which several floors or levels are interconnected by sloping ramps.

Figure 14:
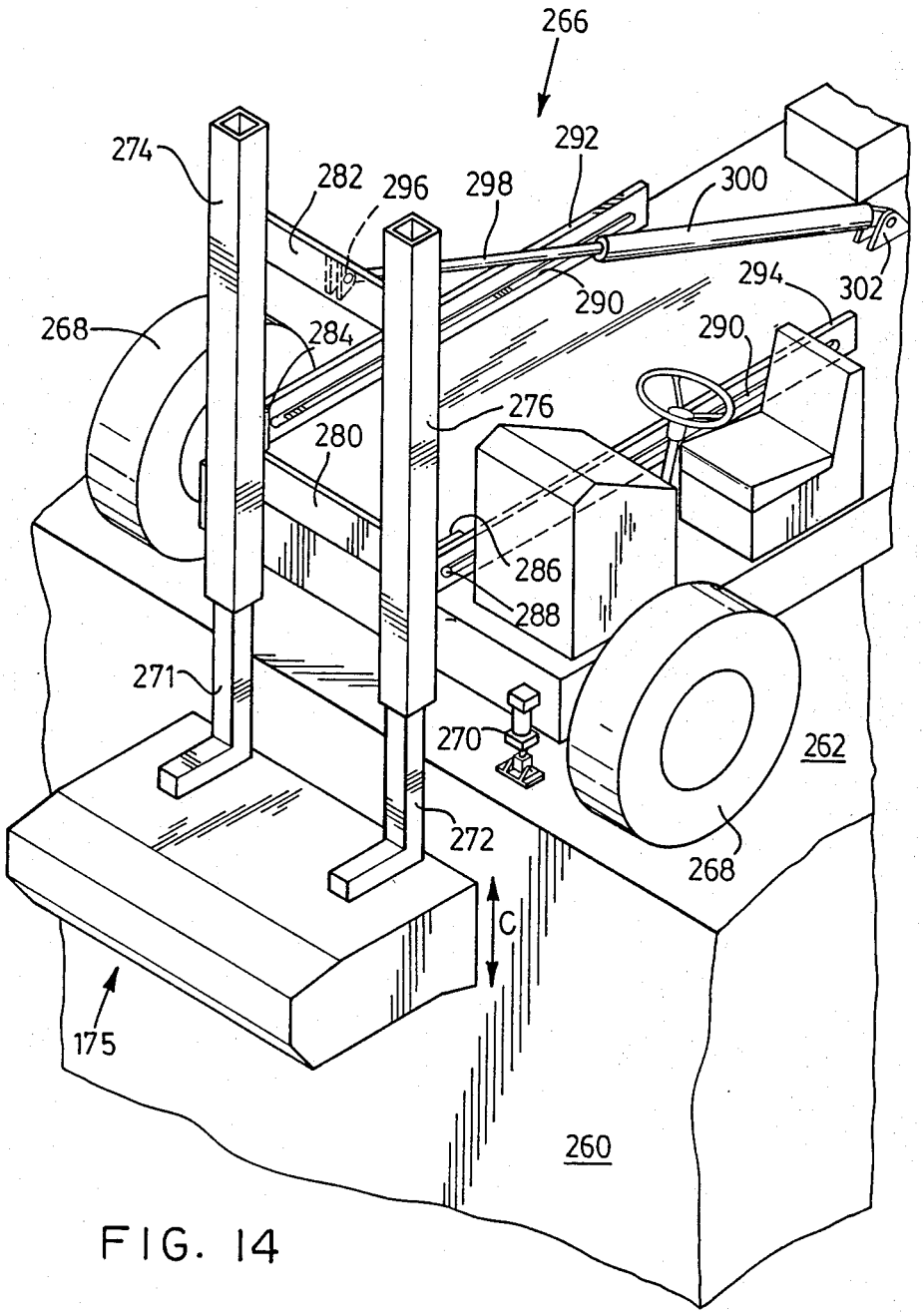
FIG. 14 is a somewhat simplified illustration of yet another embodiment of the invention.

Reference will next be made to FIG. 14 of the accompanying drawings in which there is illustrated a modification of the vehicle shown in FIG. 9 for the purpose of allowing it to be used for removing material from a vertical surface 260 of a wall below the level of a roadway 262. Such a situation arises, for example, in the repair of the vertical surface of a canal lock wall.

The vehicle shown schematically and generally at 266 in FIG. 14 comprises wheels 268 with associated jacks 270. Mounted on the vehicle 266 in a manner yet to be described is a nozzle-support assembly 175 identical with the nozzle-support assembly already described with reference to the vehicle 166 of FIG. 9. It will be understood that there is no restriction on the transverse width of the nozzle-support assembly 175 and that such assembly has been illustrated, for this particular embodiment, merely to illustrate that such assembly does not have to be the full width of the vehicle as shown for the other embodiments described herein.

The nozzle-support assembly 175 is carried by two extension arms 271 and 272 which are telescopically disposed within corresponding sleeves 274 and 276 for vertical retraction and extension as indicated by the double-headed arrow C on operation of hydraulic cylinders and controls (not shown).

The sleeve members 274 and 276 are interconnected by transverse braces 280 and 282 while rearwardly extending flanges 284 and 286 secured to the lower brace 280 are provided with stub shafts 288 which are rotatably and slidably received in slots 290 formed in upstanding guide plates 292 and 294 mounted on the vehicle 266.

A bracket 296 centrally provided on the upper brace 282 is pivotally connected to the rod 298 of a hydraulic cylinder 300 which is in turn pivotally anchored at 302 toward the rearward end of the vehicle 266. It will be understood that operation of the hydraulic cylinder 300 to cause retraction of the rod 298 will be effective to rotate the sleeves 274 and 276 into a generally horizontal position above the vehicle 266 with the nozzle-support assembly 175 disposed upwardly and somewhat forwardly of the front end of the vehicle. With the nozzle-support assembly 175 in such a raised position, the vehicle 266 can be moved to a new location.

It will also be understood that, during use of the vehicle shown in FIG. 14, the nozzle within the nozzle-support assembly 175 will be moved by a transverse drive system horizontally across the wall surface 260 and, after completing one or more scans across such surface, the controls will be operated to raise or lower the nozzle-support assembly 175 vertically relative to the vertical surface 260 a predetermined distance or increment for the next transverse scan or set of scans.

Figure 15:
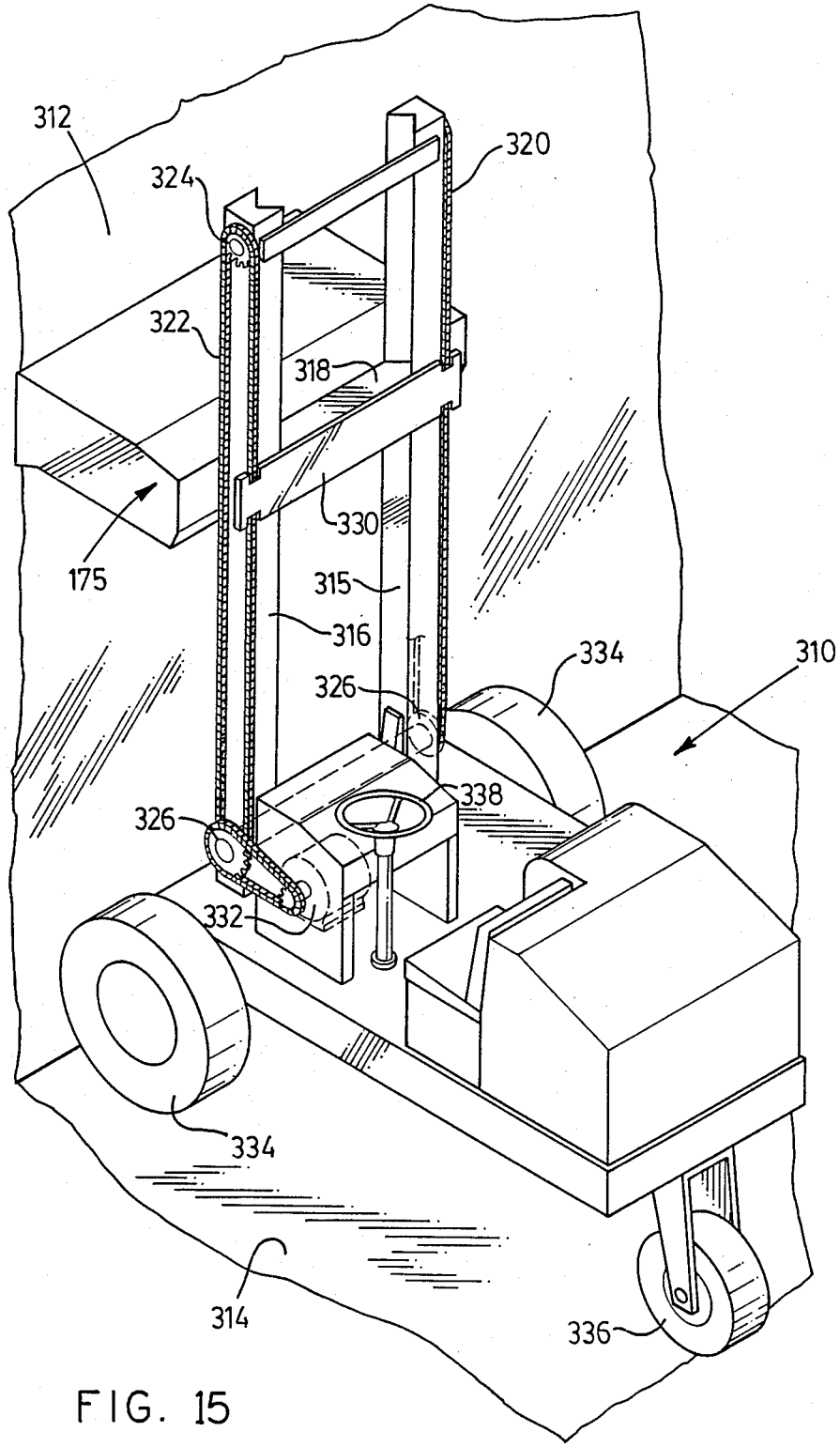
FIG. 15 is a somewhat simplified illustration showing yet another embodiment of the invention.

The vehicle generally indicated at 310 in FIG. 15 of the accompanying drawings is also intended for removing unsound concrete material from the surface of a generally vertical wall but this particular vehicle is designed for use on a wall or work surface 312 above the level of a roadway or supporting surface 314 on which the vehicle 310 is positioned.

The vehicle 310 also comprises a nozzle-support assembly 175 within which a nozzle is movably mounted for transverse scanning of a work surface such as surface 312. In this particular embodiment, the nozzle-support assembly 175 is itself movably supported between two upstanding guide rails 315 and 316 by a guide block 318. Chains 320 and 322 entrained around upper and lower sprockets 324 and 326 respectively on the guide rails 315 and 316 are terminally secured to a cross member 330 and are driven by motor 332. With this mechanism, the vertical position of the nozzle-support assembly 175 can be incrementally adjusted after each horizontal scan of the nozzle within the nozzle-support assembly 175.

For the purpose of illustrating another modification which is within the scope of this invention, the vehicle 310 is shown in FIG. 15 as being provided with two front wheels 334 and a single rear caster 336 which can be steered by steering wheel 338.

Figure 16:
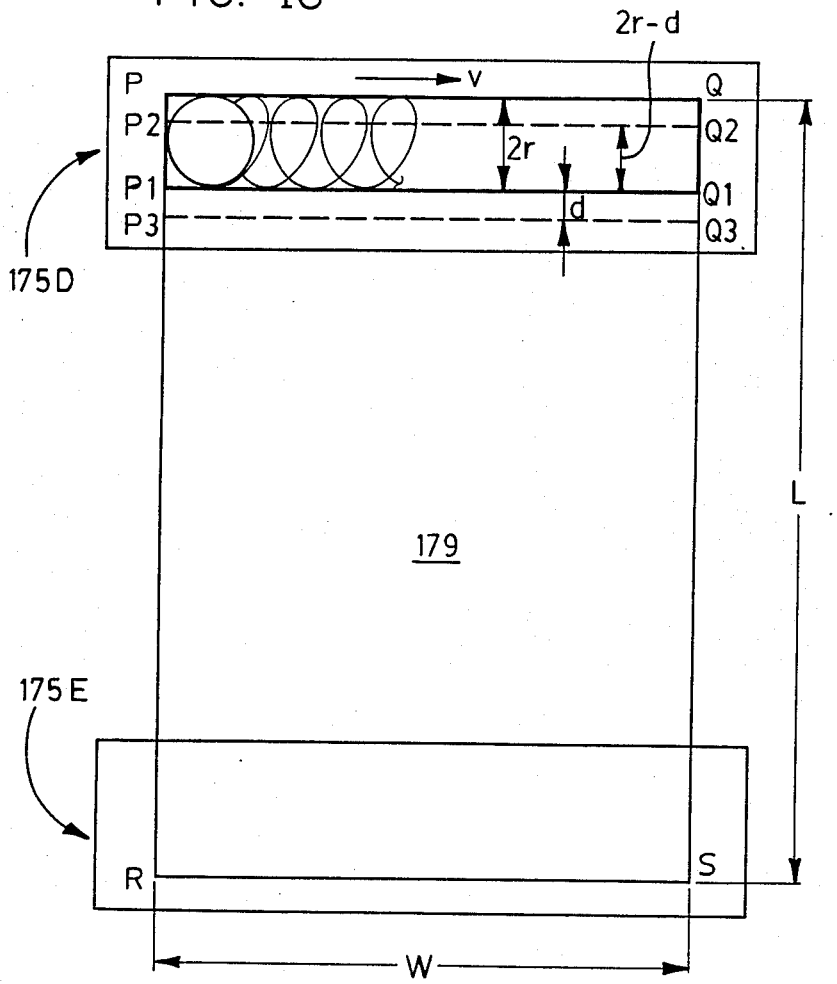
FIG. 16 is a plan view of a concrete work surface to illustrate the operation of one embodiment of the method of this invention.
Figure 17:
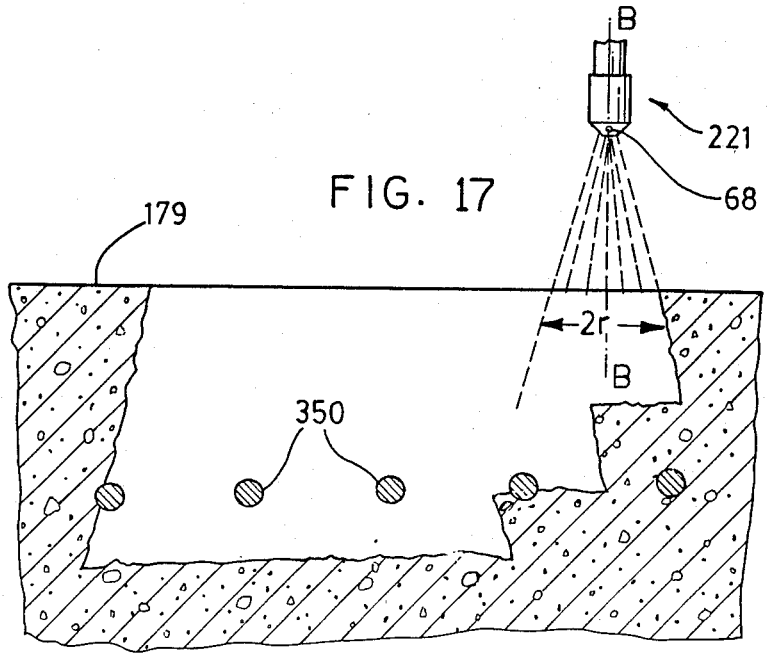
FIG. 17 is cross-sectional view through a body of concrete illustrating the operation of an apparatus and the method in accordance with this invention.

Referring now to FIGS. 16 and 17 of the accompanying drawings, there is indicated therein a section of roadway surface 179 being treated to remove old unsound concrete by the use of the vehicle or apparatus 166, shown in FIG. 9.

With vehicle 166 positioned so that the nozzle-support assembly 175 is in the position indicated at 175D with the nozzle axis B—B perpendicular to the road surface 179, that nozzle-support assembly 175 can be retracted incrementally on movement of the arms 172 from that position indicated at 175D to the position indicated at 175E so as to allow treatment of the surface area indicated by the corners marked P, Q, R and S.

In these two figures, the rotating angularly oriented water jet spray from the nozzle head 221, illustrated as having a single water discharge orifice 68, is represented as having diverged to a circle of radius "r" at the surface 179 of the roadway. The transverse width of the total area being treated is represented as "W" and the length of that area is represented as "L". In FIG. 16, the first transverse scan of the nozzle spray is shown as covering the band or strip P, Q, P1, Q1. After such first scan, the arms 172 are retracted a distance represented by "d" so that, on the following reverse scan or traverse, the spray covers the area P2, Q2, P3, Q3 which will be seen to overlap the first scan by a longitudinal (L direction) distance of "2r-d".

After completion of the second scan (the first reverse scan), the nozzle assembly is again retracted longitudinally a distance "d" for the third scan. The effect of such treatment at the end of several scans or traverses is illustrated sectionally in FIG. 17. As a result of the overlapping of the consecutive scans, the roadway material is progressively eroded to a greater depth and the removal of unsound concrete material from beneath reinforcing bars indicated at 350 is readily apparent.

It should be understood that FIG. 17 indicates a typical result obtained by carrying out the procedure taught by this invention but that considerable variations in the results actually obtained will occur in practice principally due to variations in the soundness or quality of the concrete throughout the area being treated. The results illustrated in FIG. 17 are, however, typical of those which can be achieved in accordance with this invention in removing generally unsound concrete.

The extent to which a given material is removed will depend, inter alia, on the following factors:

i. the pressure of the water jet;

ii. the radius (r) of the spray at the work surface 179, which radius will in turn depend upon both the angular orientation of the nozzle discharge orifice 68 relative to the nozzle axis B—B (FIGS. 11 and 17) and the vertical separation between the nozzle head 221 and the road surface 179;

iii. the extent (d) of each longitudinal increment;

iv. the rotational speed (w) of the nozzle;

v. the transverse velocity (v) of the nozzle;

vi. the flow rate of the water through the jet; and vii. The strength and condition of the material being removed. In general, it can be indicated that the combination of the system pressure and the discharge flow rate is normally measured as the power of the jet in horse-power. Generally, jet powers of at least 150 horse-power are utilized in the present invention.

For the pressures and flow rates already indicated herein as being preferred for use in the method of this invention, it has been found that the incremental longitudinal advance (d) per scan should preferably be less than the diameter (2r) and often less than the radius (r) of the spray at the work surface 179. It has further been found that in practice the transverse velocity (v cm per minute) is related to the rotational speed (w rpm), and the spray radius (r cm) by the following equation:

$$v \leqq 3wr.$$

Particularly useful results are obtained when the following condition is met:

$$Y = (0.85 - 1.8)wr.$$

It will be understood that, in view of the angular orientation of the water jet spray relative to the roadway surface and in view of the rotation of that jet, the concrete material and any reinforcing bars embedded in that material are impinged from many different directions. This is extremely effective in dislodging loosened aggregate from beneath such reinforcing bars to provide a clear space for new concrete material. This is also effective in cleaning and removing rust from all surfaces, including the undersurfaces, of those reinforcing bars. The fact that subsequent transverse scans of the nozzle assembly overlap each other is also effective in ensuring that the jet spray impinges on all surfaces of the reinforcing bars at many different angles. These factors are particularly important in allowing a contractor to meet the construction specifications relating to the cleanliness of the reinforcing bars before new concrete is permitted to be poured.

It will further be understood that, in many circumstances, the area of a roadway, wall or other work surface to be treated will not be rectangular but will frequently have an irregular shape or outline. For example, if the road surface of a parking building is being treated, irregular patches of concrete in heavily travelled areas might need to be removed while the concrete in adjacent and less heavily travelled areas might not need replacement. Clearly, it would be not only undesirable but also uneconomic to remove or treat areas that did not require replacement. By the use of the microprocessor automatic control system including the panel 252 (FIG. 9), it is possible automatically to control an apparatus in accordance with this invention so that it will operate selectively to treat only preselected portions of a work surface.

Figure 18:
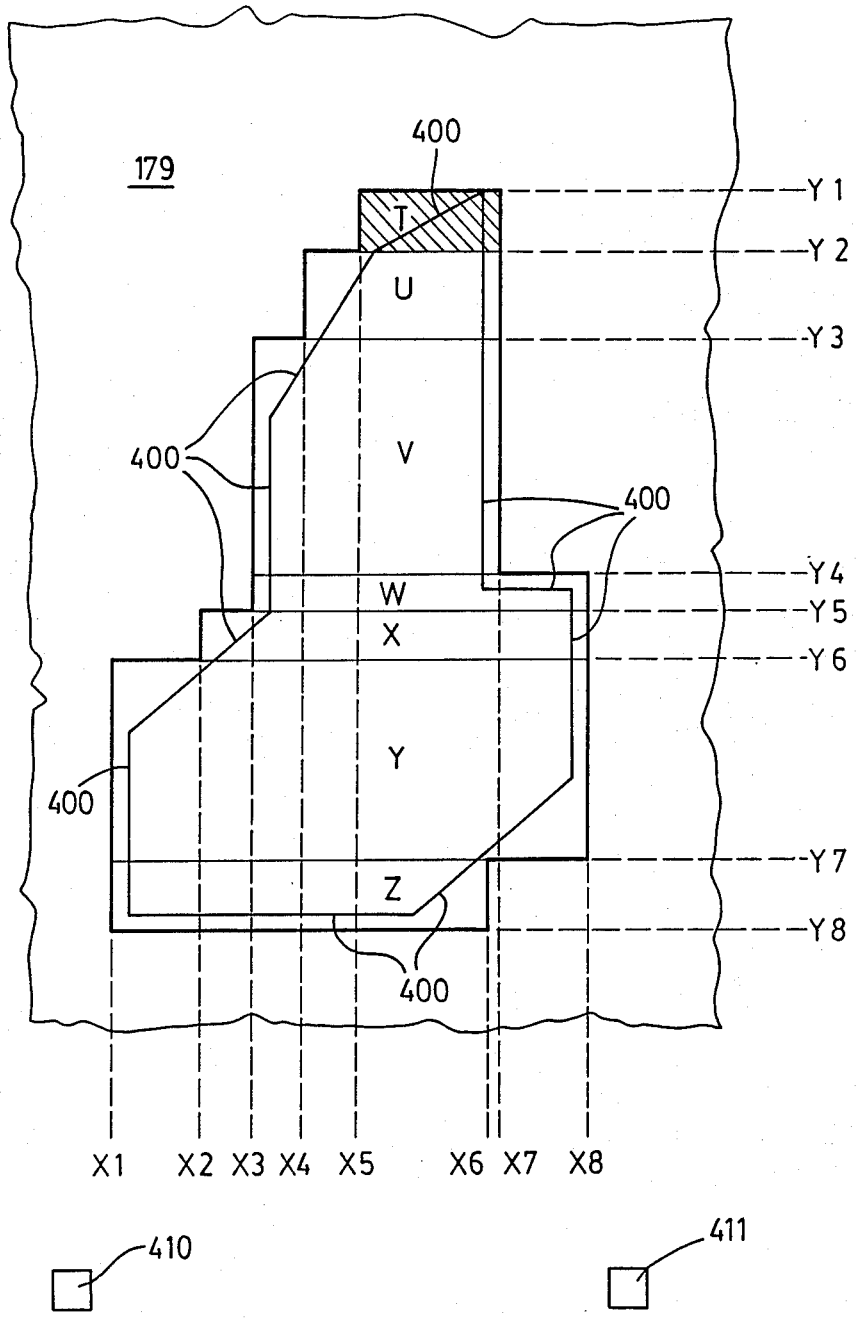
FIG. 18 is a plan view of a concrete roadway illustrating the automatic operation of yet another feature of the method provided by this invention.

In this connection, reference will be made to FIG. 18 which shows fragmentarily an area of a roadway surface 179 within which the irregularly shaped area outlined by the solid line 400 needs to be treated to remove old unsound concrete. Such an area can be divided into separate and different rectangular zones T, U, V, W, X, Y and Z and the distances of the boundaries of these zones can be measured from a predetermined reference position 410 on the roadway surface 179. Such a reference position could, for example, be the position of the left from jack of the vehicle 166. By first positioning the vehicle 166 so that the two front jacks are positioned correctly at 410 and 411 and entering the block coordinates as shown in Table I into the microprocessor, the controls will then be operative automatically to limit the extent of the nozzle transverse scans in each block to the width of that block.

It will now be seen that the present invention provides an apparatus and method for removing unsound concrete material and which apparatus and method are extremely versatile in their application so lending them to use in many different situations. Additionally, the invention provides a method and apparatus which can, if desired, for the sake of speed and efficiency, be operated automatically to treat only a desired portion, which can have an irregular boundary, of a roadway or other work surface. Other advantages of the present invention will be readily apparent to those cognizant with the relevant art.

TABLE I

| | Longitudinal | | Transverse | |
|---|---|---|---|---|
| Block | Start | Finish | Start | Finish |
| T | Y1 | Y2 | X5 | X7 |
| U | Y2 | Y3 | X4 | X7 |
| V | Y3 | Y4 | X3 | X7 |
| W | Y4 | Y5 | X3 | X8 |
| X | Y5 | Y6 | X2 | X8 |
| Y | Y6 | Y7 | X1 | X8 |
| Z | Y7 | Y8 | X1 | X6 |

The foregoing is a description of preferred embodiments of the invention which is given here by way of example only. The invention is not to be taken as limited to any of the specific features as described but comprehends all such variations thereof as come within the scope of the appended claims.

What is claimed is:

1. Apparatus for removing material from a work surface and for use in association with a source of water at a pressure within the range of from about 10,000 to about 25,000 psi, which apparatus comprises:

a support structure adapted to be stationarily disposed on a supporting surface;

extendible arm means mounted on said support structure for movement along a first linear path in only a first direction generally parallel to the work surface and away from and toward said support structure with said support structure stationarily disposed on the supporting surface;

power operated extension means attached to said support structure and to said arm means and operable to extend and retract said arm means relative to said support structure along said first linear path;

nozzle support means secured to said arm means at a position spaced apart from said support structure and in such a manner that said nozzle support means is retained in a fixed position relative to said arm means on operation of said extension means, and said nozzle support means extending angularly to said arm means in a second direction angularly oriented with respect to said first direction;

a rotatable nozzle means mounted on said nozzle support means for rotation about a nozzle axis angularly disposed with respect to the work surface and for movement along said nozzle support means in said second direction, at least one discharge orifice being provided in said nozzle means for the discharge of water under pressure therefrom in a direction angularly disposed with respect to said nozzle axis whereby water, on discharge from said nozzle means and on rotation of said nozzle means about said nozzle axis, defines an expanding cone-shaped configuration for impingement on the work surface;

a nozzle drive means attached to said rotatable nozzle means and to said nozzle support means and adapted to move said rotatable nozzle means in both directions along a second linear path in said second direction generally parallel to the work surface with said nozzle means in spaced apart disposition relative to the work surface and with said support structure stationarily disposed on the supporting surface;

spacing means for maintaining said nozzle means at a desired separation from the work surface on operation of both said extension means and said nozzle drive means; and control means operatively associated with said extension means and said nozzle drive means to cause said nozzle drive means to move said rotatable nozzle means alternately in opposite directions along said second linear path and to move said arm means along said first linear path so that water discharging from said nozzle means impinges the work surface in sequential bands.

2. An apparatus as claimed in claim 1 and in which said control means is operative to move said arm means along said first linear path so that water discharging from said nozzle means impinges the work surface in overlapping said sequential bands.

3. An apparatus as claimed in claim 2 and in which said nozzle support means is secured to said arm means so as to extend in said second direction generally perpendicularly to said first direction.

4. An apparatus as claimed in claim 3 and in which said support structure comprises a vehicle and immobilising means adapted to maintain said vehicle temporarily in a fixed position on the supporting surface during operation of the apparatus.

5. An apparatus as claimed in claim 4, in which said vehicle is supported by a plurality of wheels, and in which said immobilising means comprises at least one jack operative to elevate at least one of said wheels from the supporting surface.

6. An apparatus as claimed in claim 5 and which is adapted for removing material from a work surface which is essentially coplanar with the supporting surface.

7. An apparatus as claimed in claim 5 and in which said spacing means comprises at least one caster member secured to said nozzle support means and adapted to engage the work surface and biassing means urging said spacing means into contact with the work surface thereby to maintain said nozzle means at said predetermined separation from the work surface on operation of the apparatus.

8. An apparatus as claimed in claim 7 and in which said biassing means comprises a hydraulic cylinder means operatively connected between said nozzle support means and said extendible arm means.

9. An apparatus as claimed in claim 1 and which additionally comprises pivot means operatively interconnecting said nozzle support means and said extendible arm means and adapted to adjust the relative angular orientation of said nozzle axis and the supporting surface thereby to permit said nozzle axis to be continuously perpendicularly oriented with respect to a work surface coplanar with the supporting surface as well as with respect to a non-horizontal work surface angularly oriented with respect to the supporting surface during operation of said extension means to cause movement of said arm support means along said first linear path.

10. An apparatus as claimed in claim 1 and in which said control means is adapted to cause said extension means to move said arm means along said first linear path when said rotatable nozzle means is at an end of said second linear path.

11. An apparatus as claimed in claim 10 and in which said control means is programmable so as to cause said nozzle drive means to move said rotatable nozzle means along said second linear path between extreme positions therealong which are varied automatically in response to operation of said power operated extension means thereby to permit said overlapping sequential bands to have different lengths in accordance with a programme entered into said control means.

12. An apparatus as claimed in claim 1 and in which said control means is adapted to cause said nozzle drive means to move said nozzle support means in said second direction at a linear speed ("v" cm per minute) related to the rotational speed ("w" revolutions per minute) of the nozzle means and the radius ("r" cm) of the circular outline of the cone-shaped configuration of the water discharge from the nozzle means at the work surface by the following formula:

$$v \leqq 3wr$$

and to cause said extension means to move said rotatable nozzle means along said first linear path a distance not exceeding "2r" when said rotatable nozzle means is at an end of said second linear path.

13. An apparatus as claimed in claim 12 and in which said control means is adapted to cause said nozzle drive means to move said nozzle support means in said second direction at a linear speed defined by the following formula:

$$v=(0.85-1.8)wr$$

and to cause said extension means to move said rotatable nozzle means along said first linear path a distance not exceeding "r" when said rotatable nozzle means is at an end of said second linear path.

14. An apparatus as claimed in claim 1 and in which said extendible arm means is mounted on said vehicle so that said first linear path is essentially perpendicular to the supporting surface, whereby, when said vehicle is disposed on a generally horizontal surface, said apparatus can be utilized for removing material from a generally vertical work surface.

15. An apparatus as claimed in claim 14 and in which said extendible arm means is pivotally mounted on said vehicle for movement between a retracted position and a generally vertical operating position.

16. A method for removing material from a work surface which comprises the steps of:

pressurizing water to a pressure within the range of from about 10,000 to about 25,000 psi;

discharging said water under pressure through a movable and rotatable nozzle means supported on a stationary structure by an extendable arm means mounted on said stationary structure for movement along a first linear path in a first direction generally parallel to the work surface and away from and toward said stationary structure and by a nozzle support means secured to said arm means at a position spaced apart from said stationary structure and extending angularly to said arm means in a second direction angularly oriented with respect to said first linear path, said arm means being secured to said stationary structure and said nozzle support means being secured to said arm means in such a manner that said nozzle support means is retained in a fixed position relative to said arm means on movement of said arm means along said first linear path, said stationary structure being disposed on a supporting surface, and said nozzle means being spaced apart from said work surface and having at least one water discharge orifice disposed so that said discharge occurs in a direction angularly oriented with respect to an axis of said nozzle means;

rotating said nozzle means about said axis thereof whereby said water on said discharge from said nozzle means defines an expanding cone-shaped configuration impinging said work surface;

moving said nozzle means relative to said stationary structure along a second linear path in said second direction generally parallel to the work surface between extreme positions therealong so that said water discharging from said nozzle means impinges said work surface in a first band;

moving said nozzle means relative to said stationary structure along a first linear path in said first direction and generally parallel to the work surface and angularly disposed with respect to said second linear path;

again moving said nozzle means across said work surface along a said second linear path to define a second band;

repeating said movements of said nozzle means along said first and second linear paths a predetermined number of times until the entire work surface has been treated; and maintaining said nozzle means at a predetermined distance from said work surface throughout the entire treatment of said work surface.

17. A method as claimed in claim 16 and which comprises moving said nozzle means along said first path a distance such that said second band overlaps said first band.

18. A method as claimed in claim 17 and which comprises discharging said water through said nozzle means at a flow rate of from about 60 to about 120 liters per minute.

19. A method as claimed in claim 16 and which comprises moving said nozzle means along mutually perpendicular said first and second linear paths.

20. A method as claimed in claim 16 and which comprises moving said nozzle means along a non-horizontal said first linear path for treatment of a non-horizontal work surface which is angularly disposed with respect to said supporting surface.

21. A method as claimed in claim 20 and which comprises moving said nozzle means along a first said linear path which is generally perpendicular to said supporting surface.

22. A method as claimed in claim 21 and which comprises moving said nozzle means along a generally vertical said first linear path.

23. A method as claimed in claim 16 and which comprises moving said nozzle means along said first linear path only at the end of a said movement of said nozzle means along said second linear path.

24. A method as claimed in claim 23 in which said nozzle means is moved across said work surface along said second linear path at a linear speed ("v" cm per minute) related to the rotational speed ("w" revolutions per minute) of the nozzle means and said radius ("r" cm) of said generally circular configuration of said impingement of said water discharge against said work surface, by the following formula:

$$v \leqq 3wr$$

and in which said nozzle means is moved along said first linear path a distance not exceeding "2r" at the end of a said movement of said nozzle means along said second linear path.

25. A method as claimed in claim 24 in which said nozzle means is moved across said work surface along said second linear path at a linear speed defined by the following formula:

$$v=(0.85-1.8)wr$$

and in which said nozzle means is moved along said first linear path a distance not exceeding "r" at the end of a said movement of said nozzle means along said second linear path.

26. A method as claimed in claim 16 and which comprises the additional step of moving said stationary structure after the entire work surface has been treated, to a second location, and then repeating said operating steps in sequence to remove material from a different part of such a work surface.

27. A method as claimed in claim 16 and which comprises varying the length of said movement of said nozzle means along said second linear path after predetermined movement of said nozzle means in said direction of said first linear path, thereby to remove material from an irregularly shaped part of such a work surface.

* * * * *